US007318422B2

(12) United States Patent
Douyama et al.

(10) Patent No.: US 7,318,422 B2
(45) Date of Patent: Jan. 15, 2008

(54) FLUID PUMP ASSEMBLY

(75) Inventors: Yoshiaki Douyama, Shiroishi (JP); Joseph M. Graham, Cass City, MI (US); Kerry E. Griffka, Ubly, MI (US); Kevin L. Israelson, Cass City, MI (US); Ronald H. Roche, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 190 days.

(21) Appl. No.: 11/190,427

(22) Filed: Jul. 27, 2005

(65) Prior Publication Data

US 2007/0025866 A1 Feb. 1, 2007

(51) Int. Cl.
*F02M 37/04* (2006.01)

(52) U.S. Cl. ..... 123/495; 123/509

(58) Field of Classification Search ..... 123/495, 123/497; 417/349, 365

See application file for complete search history.

(56) References Cited

U.S. PATENT DOCUMENTS

| | | | | | |
|---|---|---|---|---|---|
| 1,773,211 | A * | 8/1930 | Wilsey | 418/9 |
| 3,363,579 | A * | 1/1968 | Bolster | 418/132 |
| 3,499,390 | A * | 3/1970 | Prijatel | 418/132 |
| 3,713,759 | A * | 1/1973 | Pollman et al. | 418/71 |
| 4,130,383 | A * | 12/1978 | Moinuddin | 418/78 |
| 4,484,870 | A * | 11/1984 | Erasov | 418/61.3 |
| 4,519,755 | A * | 5/1985 | Hanson | 418/9 |
| 4,762,480 | A * | 8/1988 | Winkler et al. | 418/266 |
| 5,244,367 | A * | 9/1993 | Aslin | 418/104 |
| 5,697,769 | A | 12/1997 | Kobman et al. | |
| 6,158,975 | A | 12/2000 | Dill et al. | |
| 6,174,151 | B1 * | 1/2001 | Yarr | 418/171 |
| 6,196,200 | B1 | 3/2001 | Roche | |
| 6,231,318 | B1 | 5/2001 | Cotton et al. | |
| 6,332,522 | B1 * | 12/2001 | Morse et al. | 192/85 AA |
| 6,386,836 | B1 * | 5/2002 | Johnson | 417/310 |
| 6,612,822 | B2 * | 9/2003 | Buschur et al. | 418/171 |

* cited by examiner

*Primary Examiner*—Thomas Moulis
(74) *Attorney, Agent, or Firm*—Reising, Ethington, Barnes, Kisselle, P.C.

(57) ABSTRACT

A fluid pump includes an electric motor with a casing and a drive shaft extending from the casing, a pumping element coupled to the drive shaft for rotation with the shaft to take in fluid and discharge it under pressure. The fuel pump casing may be sealed and a housing coupled to the casing may provide the inlet and outlet passages for fluid flow to and from the pumping element. The housing may be received in or communicated with other housing or module assemblies to provide a wide array of fuel pump assemblies. The pumping element may include one or more gear rotors, a turbine pumping element, or other pumping element, as desired.

48 Claims, 12 Drawing Sheets

FLUID PUMP ASSEMBLY

FIELD OF THE INVENTION

The present invention relates generally to pumps, and more particularly to fluid pump assemblies.

BACKGROUND OF THE INVENTION

Various fluid pumping arrangements are known. For example, vehicle fuel systems commonly utilize an electric motor fuel pump to deliver pressurized fuel from a fuel tank to the engine to support engine operation. The electric motor pumps include so-called turbine-type pumping assemblies, as well as gear rotor and other positive displacement fluid pumps. A housing generally encloses both an electric motor and the fluid pump components of the pump assembly. The pump assembly may be disposed outside of a supply of fluid, such as a fuel tank in a fuel system application or in a fuel line leading to the engine, or in the supply of fluid such as within a fuel tank or fuel vapor separator. Electric motor driven pumps are used in a wide range of vehicles including passenger vehicles, vans, trucks, off-road vehicles, motorcycles, watercraft, and the like.

SUMMARY OF THE INVENTION

A fluid pump including an electric motor with a casing and a drive shaft extending from the casing and a pump housing coupled to the casing, enclosing at least part of the drive shaft and having an inlet through which fluid enters the housing and an outlet through which fluid exits the housing. An inner gear rotor is coupled to the drive shaft for rotation with the shaft about an axis and an outer gear rotor is driven for rotation by the inner gear rotor providing a plurality of pumping chambers between the inner gear rotor and outer gear rotor. A wear plate is disposed between motor and the inner and outer gear rotors, and has an inlet port in communication with the inlet and through which fluid enters the pumping chambers, and an outlet port in communication with the outlet and through which pressurized fluid is discharged from the pumping chambers.

In one presently preferred implementation, the wear plate, inner gear rotor and seal are all drivingly coupled to the drive shaft for rotation with the drive shaft. Preferably, these rotating parts are journalled or guided for rotation within the housing. Also preferably, the housing may be releasably coupled to the electric motor so that a common electric motor design may be used for a wide range of pump assemblies. The housing may be disposed within other housings to control the direction and flow of fluid discharged there from. The other housings may be adapted for use with an inline pump, side channel discharge or disposition within one or more modules, as set forth herein. And one or more housings and the electric motor may be used with other types of fluid pumping elements such as turbine or other regenerative fuel pump designs, by way of example without limitation.

At least some potential objects, features and advantages of the fluid pump assembly set forth herein include providing a modular fluid pump that can be produced in relatively low volume, provides an arrangement of pumping elements that can be utilized in several different housing and module constructions, permits use with sealed motor modules, provides a compact and relatively simple construction and arrangement of the pumping elements, provides a pumping element driven directly by a motor drive shaft, permits use of a range of fuel pumping elements, is of relatively simple design, economical manufacture and assembly, rugged, durable, and in service has a long, useful life.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 13:
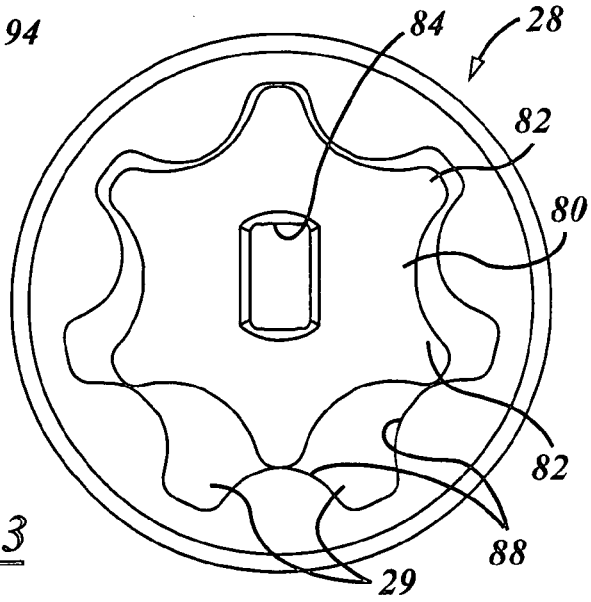
FIG. 13 is a plan view of intermeshed inner and outer gear rotors.

Referring in more detail to the drawings, FIGS. 1-4 illustrate an electric motor fluid pump assembly 10 which may be used to pump liquids such as liquid fuel and is adapted to take in fuel through an inlet 12, pressurize the fuel and discharge pressurized fuel through an outlet 14. The fuel pump assembly 10 preferably includes a motor module 16 that has an electrically driven motor 18 (FIG. 2) at least partially enclosed within an outer shell or casing 20, and a drive shaft 22 extending from the casing 20 and driven for rotation by the motor 18. A fuel pump element assembly 24 includes a housing 25 coupled to the casing 20 and a gear rotor set 28 disposed generally within the housing 25 and defining fuel pumping chambers 29 (FIG. 13) in which fuel is taken in at relatively low pressure and discharged from at a relatively high pressure. In one presently preferred implementation, the housing 25 includes a mounting plate 30 connected to the motor module 16 and a pump body 26 carried by the mounting plate 30 or casing 20.

The motor module 16 may include a conventional DC motor having a stator and an armature enclosed by the casing 20 with the drive shaft 22 extending out of the casing 20. The casing 20 may include end caps 32, 34 at opposite ends of the motor 18 and a cylindrical metal cover 36 disposed around a portion of each end cap 32, 34. The casing 20 may have one or more openings 35 that admit fluid into the casing to, for example, facilitate cooling the motor unit. An electric motor generally suitable for use with a fuel pump is disclosed generally in U.S. Pat. No. 6,106,256, the disclosure of which is incorporated herein by reference in its entirely. The electric motor 18 may include a conventional commutator and brushes, or may be a so-called "brushless" type motor, or any other suitable motor for driving the gear rotor set 28 to pump fuel. One suitable electric motor module is currently available from Johnson Electric headquartered in Hong Kong as part of their 400 series of motors and including model number HC476XLLG. Accordingly, the electric motor module 16 will not be discussed further herein.

Figure 1:
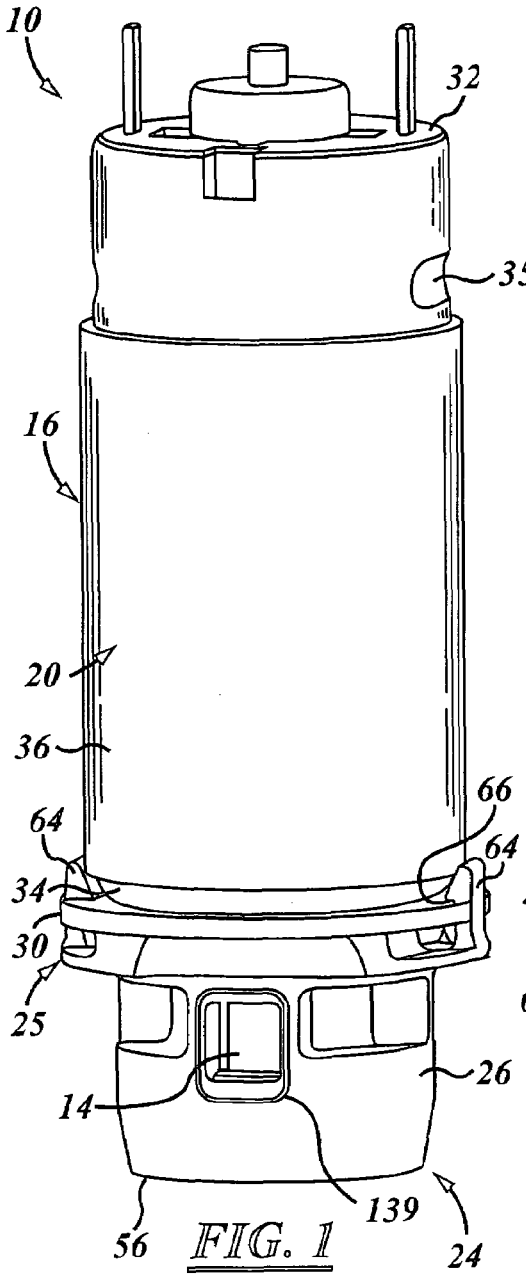
FIG. 1 is a perspective view of one presently preferred implementation of a fluid pump assembly.
Figure 2:
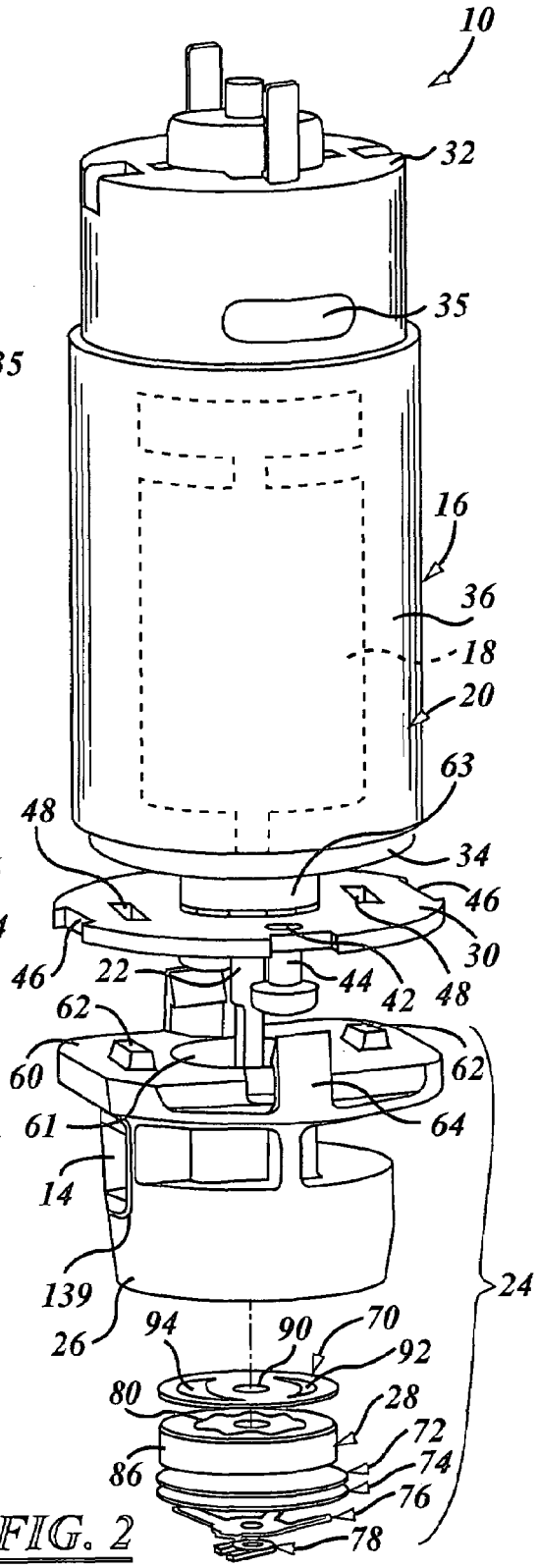
FIG. 2 is an exploded perspective view of the fluid pump assembly of FIG. 1.
Figure 12:
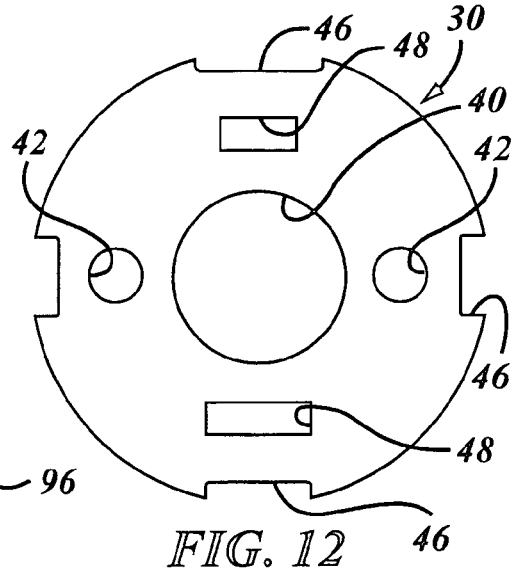
FIG. 12 is a plan view of a mounting plate of the fluid pump assembly.
Figure 11:
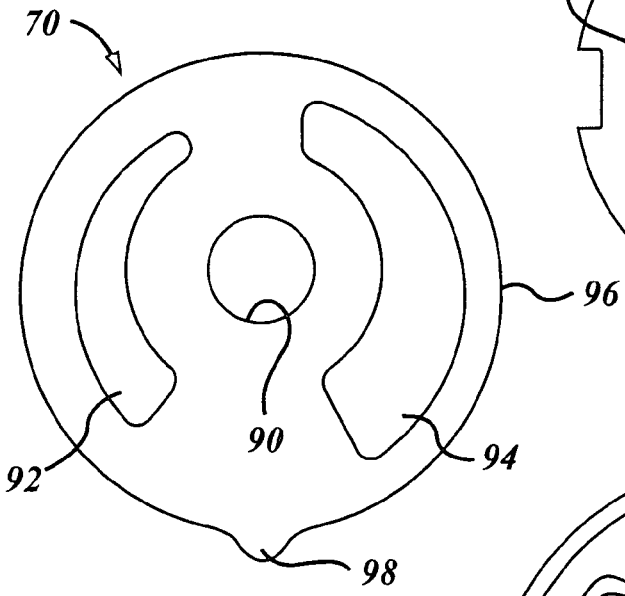
FIG. 11 is a plan view of an outlet wear plate.

As best shown in FIGS. 2 and 12, the mounting plate 30 is preferably a generally circular flat disk with a central opening 40 through which the drive shaft 22 extends and one or more openings 42 spaced from the central opening 40 through which suitable connectors, such as screws 44, may be used to connect the mounting plate 30 to the motor casing 20. Generally, about the periphery of the mounting plate 30, a plurality of notches 46 may be provided and one or more slots 48 or key holes may be provided in the plate to facilitate retention and alignment of the pump body 26.

As best shown in FIGS. 1-6, 7A and 7B, the pump body 26 is preferably a one-piece, molded polymeric structure with a bore 50 in which the drive shaft 22 extends, a first counter bore 52 in which the gear rotor set 28 is received in assembly, and a second counter bore 54 leading to an open lower end 56 of the body 26. The axis of the first counterbore 52 preferably is radially offset from the axis of the bore 50 and the drive shaft 22. A radially outwardly extending groove or notch 53 is preferably formed in the sidewall of the first counterbore 52 and may extend axially along the length of the sidewall. An end surface 51 of the first counterbore 52 includes an arcuate inlet slot 55 through which the inlet 12 is communicated with the pumping chambers 29 of the gear rotor set 28, and an arcuate outlet slot 57 which receives fuel discharged from the pumping chambers 29. A fuel passage 58 leads from the outlet slot 57 to the outlet 14 of the pump body 26 to route pressurized fuel discharged from the gear rotors 28 to the outlet 14. A bore 59 communicates the second counterbore 54 with the passage 58.

The pump body 26 may have a generally planar face 60 with a recess 61 (FIGS. 2, 3 and 6) that receives a drive shaft bearing portion 63 (FIGS. 2 and 3) extending from the motor casing 20. The bearing portion 63 may sealingly engage an annular and axially raised crush rib 65 (FIGS. 5, 6 and 7A) that surrounds the bore 50. The pump body 26 preferably includes one or more upstanding projections 62 that are received in the slots 48 of the mounting plate 30 to facilitate locating and maintaining the position of the pump body 26 relative to the mounting plate 30. One or more resilient and at least somewhat flexible fingers 64 extend upwardly from the face 60 and include radially inwardly extending catches 66, which are snap-fit received over a portion of the mounting plate 30 to couple the pump body 26 to the mounting plate 30. Desirably, the fingers 64 are disposed within the peripheral notches 46 formed in the mounting plate 30 that locate the pump body 26 and with the projections 62 received in the slots 48, hold it against rotation relative to the mounting plate 30.

As best shown in FIGS. 2-4 and 8-13, the fuel-pumping element assembly 24 also includes an inlet and outlet wear plate 70, the gear rotor set 28, a seal 72, a backup disk 74, a biasing member 76, and a retainer 78 all preferably disposed about the drive shaft 22. The gear rotor set 28 includes an inner gear rotor 80 with radially outwardly extending teeth 82 and a non-circular central opening 84 co-axially aligned with the drive shaft and through which the drive shaft 22 is received. The drive shaft 22 is preferably complementary in shape to the central opening 84 providing one or more driving surfaces on the shaft 22 that engage the inner gear rotor 80 for rotation of the inner gear rotor 80 with the drive shaft 22. The outer gear rotor 86 includes radially inwardly extending teeth 88 preferably greater in number than the number of teeth of the inner gear rotor 80 and is generally in the form of a ring gear. The outer gear rotor 86 is eccentrically aligned relatively to the inner gear rotor 80 (e.g. its axis of rotation is offset form the axis of rotation of the inner gear rotor 80) and is disposed for rotation in the counter bore 52 of body 26. The first counterbore 52 preferably defines a pocket with an axially extending wall 89 that guides the outer gear rotor for rotation and may act as a bearing surface. As the drive shaft 22 and gear rotors 80, 86 rotate, the pumping chambers 29 are defined between the inner gear rotor 80 and outer gear rotor 86. The pumping chambers 29 enlarge in the area of the fuel pump inlet 12 creating a decreased pressure in that area so that fuel enters into the pumping chambers 29. The pumping chambers 29 become smaller or ensmall in the area of the fuel pump outlet 14 increasing the pressure of fuel in the pumping chambers 29 and discharging that fuel under pressure for delivery from the fuel pump.

The wear plate 70 is preferably a generally flat disk including a central opening 90 in which the drive shaft 22 is received for rotation relative to the wear plate 70. The wear plate 70 is received in the first counterbore 52 and may be guided for rotation by the surfaces of the first counterbore 52. The wear plate 70 is also disposed directly adjacent to one face of the gear rotor set 28 and includes circumferentially spaced inlet and outlet ports 92, 94, respectively. The inlet port 92 is preferably a generally arcuate slot formed radially inwardly from an outer edge 96 of the plate 70 and radially spaced from the central opening 90. The outlet port 94 preferably also is a generally arcuate slot disposed radially inwardly from the outer edge 96 of the plate 70 and radially spaced from the central opening 90, and generally diametrically opposed to the inlet port 92. The remainder of the wear plate 70 preferably seals the corresponding area of the gear rotors 28 it overlies. The wear plate 70 preferably includes an outwardly extending tab or key 98, that is received in the notch 53 of the pump body 26 to prevent rotation of the wear plate 70 relative to the body 26, and so that the gear rotor set 28 and drive shaft 22 rotate relative to the wear plate 70. The inlet port 92 is aligned with the inlet slot 55 of the pump body 26 and overlies a portion of the gear rotor set 28 in which the pumping chambers 29 are increasing in volume which thereby creates a decreased pressure, taking fuel into the pumping chambers 29 through the inlet port 92. The outlet port 94 is aligned with the outlet slot 57 of the pump body 26 and is disposed over an area of the gear rotor set 28 wherein the pumping chambers 29 are decreasing in volume. Fuel is discharged under pressure from the gear rotor set 28 through the outlet port 94 of the plate 70. The wear plate preferably is formed from a thin, flexible sheet such as Teflon coated or impregnated fiberglass, or any other suitable material that preferably reduces friction between the gear rotor set 28 and the pump body 26, including plastics such as acetel, and nylon, among others.

Figure 8:
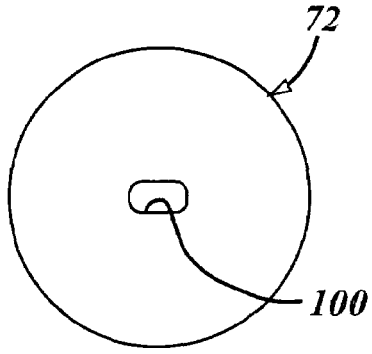
FIG. 8 is a plan view of a seal of the fluid pump assembly.

As shown in FIG. 8, the seal 72 is preferably a generally flat, circular disk having a non-circular central opening 100 that preferably is complementarily shaped to the drive shaft 22 so that the seal 72 rotates with the drive shaft 22 and the gear rotor set 28. This reduces wear on the seal 72 by reducing or eliminating relative rotational movement between the seal 72 and the gear rotor set 28. The seal 72 preferably is thin and flexible like the wear plate, and preferably is formed of the same material as the wear plate 70, but can be formed from any suitable material. The seal 72 is disposed adjacent to the opposite face of the gear rotor set 28 from the wear plate 70 and at least substantially inhibits or prevents fuel flow into or from the gear rotor set 28 through that face of the gear rotor set 28. The seal 72 may be received in the second counterbore and may have an outer diameter larger than the diameter of the first counterbore. The seal 72 may be guided for rotation by a radially extending end surface 104 of the counterbore 54. Accordingly, at least substantially all of the fuel enters and is discharged from the gear rotor set 28 through the wear plate 70, which overlies the surface of the gear rotors facing the motor 18.

As shown in FIG. 2, the backup disk 74 is preferably disposed adjacent to the seal 72. The backup disk 74 preferably includes a generally flat, circular disk formed of a preferably thin and somewhat flexible material that is somewhat stiffer and has a higher spring rate than the material of the seal 72, such as stainless steel, brass, high carbon steel, beryllium, by way of examples without limitation. The backup disk 74 is disposed directly adjacent to the face of the seal 72 opposite the gear rotor set 28, and preferably includes a non-circular central opening (not shown) so that the backup disk 74 is driven for rotation with the drive shaft 22, seal 72 and gear rotor set 28.

Figure 9:
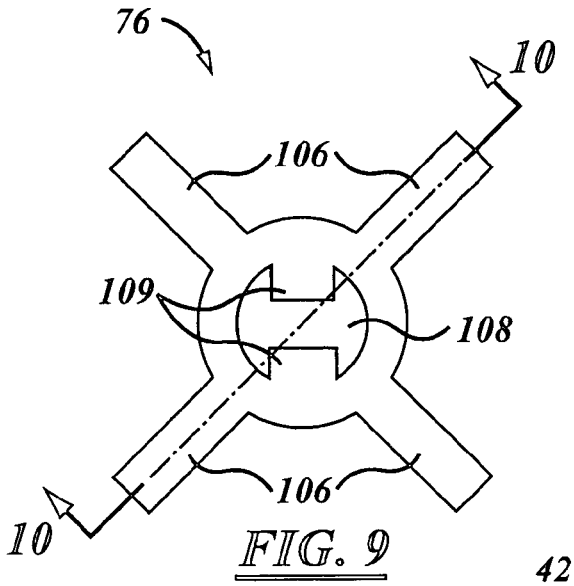
FIG. 9 is a plan view of a biasing member of the fluid pump assembly.
Figure 10:
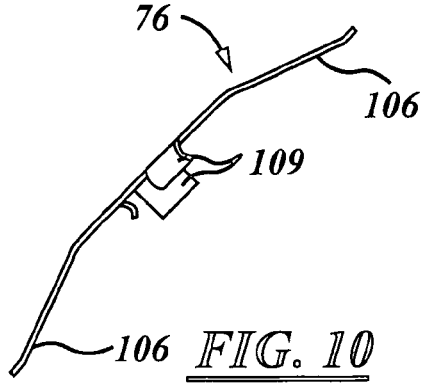
FIG. 10 is a sectional view of the biasing member taken generally along line 10-10 in FIG. 9.

As shown in FIGS. 9 and 10, the biasing member 76 may be a spring element including radially outwardly extending and bent fingers 106 disposed adjacent and in engagement with the face of the backup disk 74 opposite the seal 72. The spring 76 preferably includes a non-circular central opening 108 for driving engagement with the drive shaft 22 so that the spring 76 rotates with the drive shaft 22, and other components. The bent fingers 106 of the spring 76 are resilient, flexible and at least somewhat loaded or flexed against the backup disk 74 to yieldably bias the seal 72 against the gear rotor set 28. The spring may also include retainer tabs 109 that limit movement of the spring relative to the shaft 22. The tabs 109 can be provided in any orientation and number, as desired. The spring 76 preferably maintains the axial contact of the fuel pumping elements 28, 70, 72, 74 to limit leakage between them. Of course, other biasing member constructions or arrangements can be utilized, as desired. Additionally, at least when the lower end 56 of the pump body 26 is closed off, such as is shown in certain embodiments discussed hereafter, fluid discharged from the gear rotors 28 is communicated through the bore 59 with the side of the backing plate 74 and seal 72 opposite the gear rotors 28 to further bias the seal against the gear rotors 28. This helps prevent or reduce fluid leakage from the gear rotors and increases the performance and efficiency of the pump assembly 10.

As best shown in FIG. 2, a retainer 78 such as a "C" or E-clip is preferably disposed on the drive shaft 22 to retain the other fuel pump components 28, 70, 72, 74, 76 on the drive shaft 22, and to maintain the position of the spring 76 so that the spring 76 provides a desired biasing force onto the backup disc 74 and the seal 72 and remainder of the fuel pump components.

Accordingly, the fuel pump element assembly 24 including the body 26, and the pump components mounted on the drive shaft 22 can be used with substantially any electric motor 18 including a drive shaft 22 on which the pump elements may be mounted. All of the components of the pump element assembly 24 can readily be assembled on to the drive shaft in a compact, efficient, and relatively simple and low cost arrangement, since the open lower end 56 of the body 26 is effectively closed by the seal 72 and the fuel enters and is discharged from the opposite face of the gear rotors 28. Hence, the body 26 can be snap-fit onto the plate 30 and motor module 16, and the pump elements (70, 28, 72, 74, 76, 78) can thereafter be assembled onto the drive shaft 22. The electric motor casing 20 may be sealed, or open such that at least a portion of the fuel discharged from the gear rotors 28 flows through the casing 20 and is discharged therefrom under pressure. In that regard, the housing outlet 14 may communicate with an opening in the casing 20 so that fuel discharged from the pump body 26 flows through the motor casing 20. Of course, other constructions and arrangements may be employed, as desired for a given application.

Figure 14:
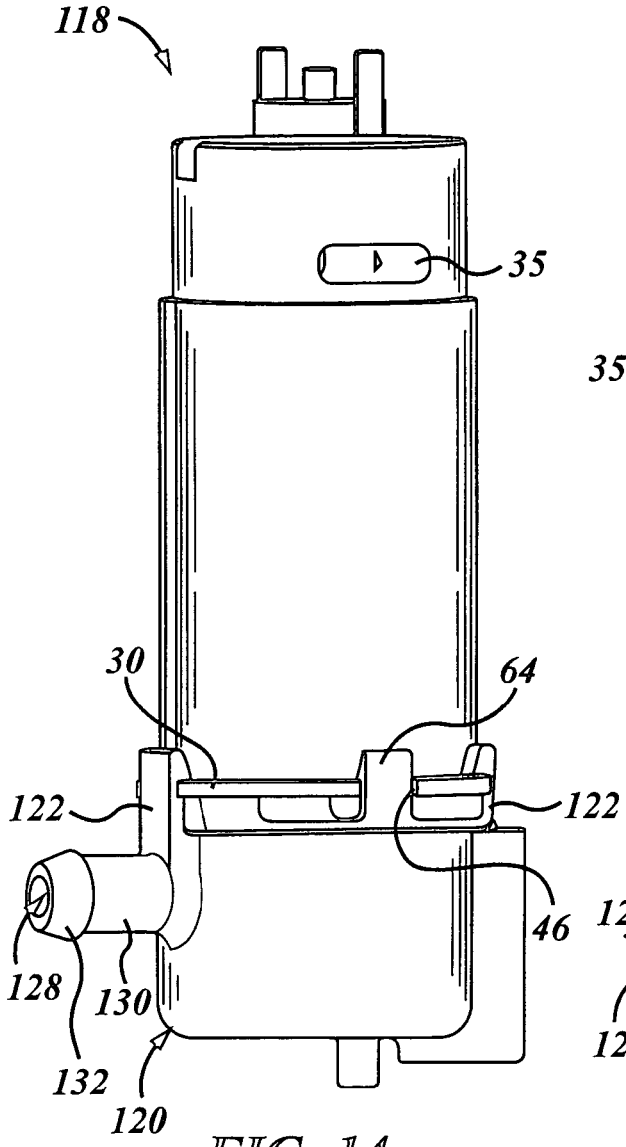
FIG. 14 is a side view of an alternate embodiment fluid pump assembly.
Figure 15:
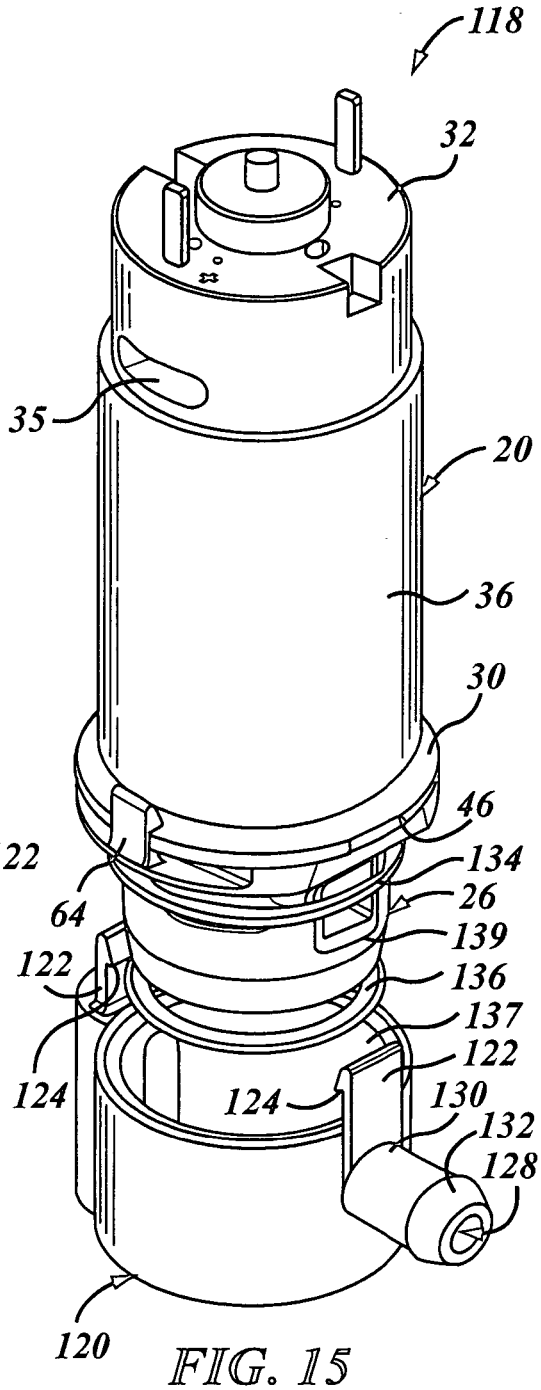
FIG. 15 is an exploded perspective view of the fluid pump assembly of FIG. 14.
Figure 16:
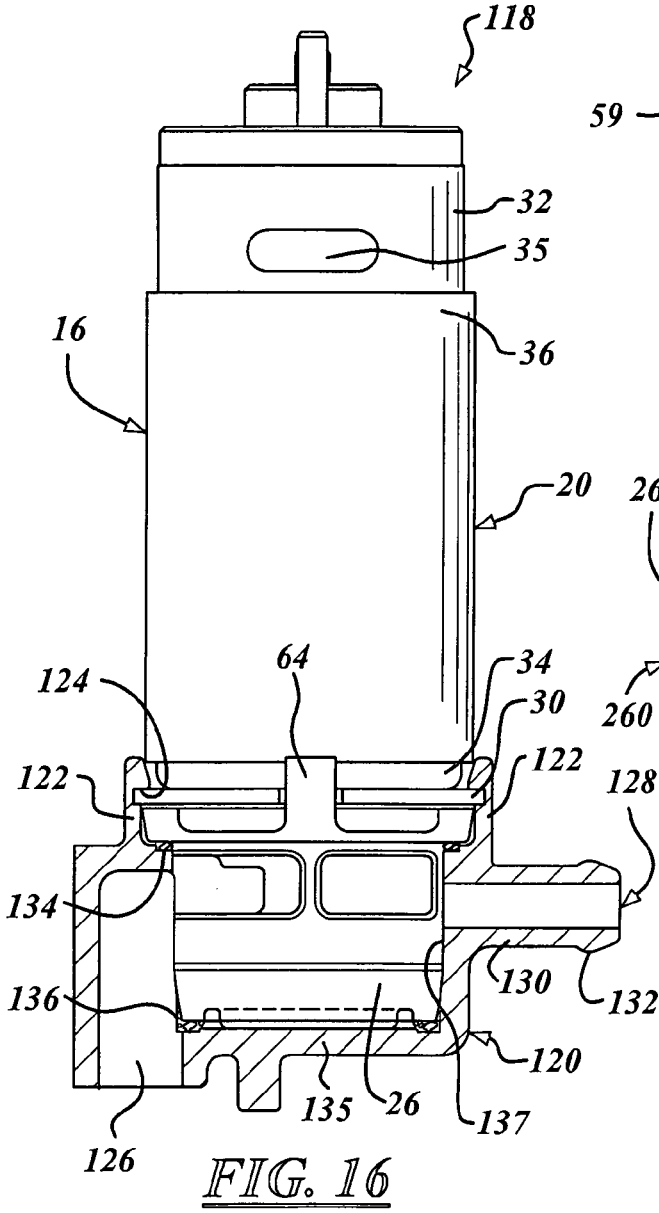
FIG. 16 is a side view partially in section of the fluid pump assembly of FIG. 14.
Figure 7B:
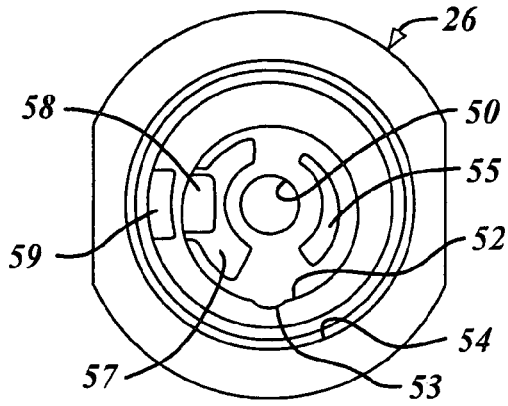
FIG. 7B is a bottom view of the housing.

As best shown in FIGS. 14-16, a fuel pump assembly 118 may include the fuel pump assembly 10 described with reference to FIGS. 1-13 and a second housing 120 carried by the mounting plate 30 and disposed generally surrounding at least a portion of the pump body 26. The fuel pump assembly may be disposed in a fuel tank. The second housing 120 preferably includes one or more flexible and resilient fingers 122 each having a catch 124 that radially overlaps a portion of the mounting plate 30 and preferably each finger 122 is disposed within a corresponding notch 46 formed in the mounting plate 30 to hold the second housing 120 in position relative to the mounting plate 30. Desirably, the fingers 122 of the second housing 120 are circumferentially spaced from the fingers 64 of the pump body 26. In this manner, the second housing 120 may be snap-fit on to the mounting plate 30 and over the pump body 26.

The second housing 120 preferably includes an inlet 126 (FIG. 16) through which fuel is received for communication with the gear rotor set 28 through the inlet 12, and an outlet 128 in communication with the outlet 14 of the pump body 26. The outlet 128, in the implementation shown in FIGS. 14-16, extends radially outwardly from the second housing 120 and includes a fitting 130 with a barb 132 on which a flexible fuel line may be press fit and retained. Preferably, a pair of axially spaced apart and circumferentially continuous seals or gaskets 134, 136 are disposed between the second housing 120 and the pump body 26 to prevent fuel discharged from the fuel pump from leaking between the housing and out of the fuel pump assembly. Fluid discharged from the gear rotors 28 is communicated with the second counterbore 54 by the bore 59 and provides pressurized fluid acting on the backing plate 74 and seal 72 as previously discussed. That fuel is contained between the pump body 26, the gasket 136 and a lower wall 135 of the second housing 120. An inner surface 137 of the second housing 120 may sealingly engage an outwardly extending rib 139 (best shown in FIGS. 1, 2, 4 and 15, and which may be a so-called "crush rib") that circumscribes the outlet opening 14 to reduce or prevent fuel leakage in the area of the outlet 14. The second housing 120 preferably is molded in one piece of a polymeric material suitable for use in the fluid being pumped. Representative examples for use in liquid fuel include acetel, PPS, Celcon M-90, Delrin 500 or the like.

In this manner, the fuel pump assembly 10 described with reference to FIGS. 1-13 can be readily incorporated with the second housing 120 providing a desired orientation and location of the inlet and outlet passages 126, 128 for ease in adapting the fuel pump assembly 10 to a given application or fuel system design. Of course, the pumping element may be different from the gear rotor set 28 and associate components described with reference to FIGS. 1-13, and may include other gear rotor pumping elements, turbine-type impeller pumping elements, or other pumping elements, as desired for a particular application. Regardless of the type of pumping element used, a similar modular electric motor 16 may be used, if desired, with one or both of the pump body 26 and second housing 120 to provide a desired routing and handling of the inlet and outlet fuel. Also, a check valve may be provided in the outlet 128 or elsewhere in the flow of outlet fuel as desired.

Figure 17:
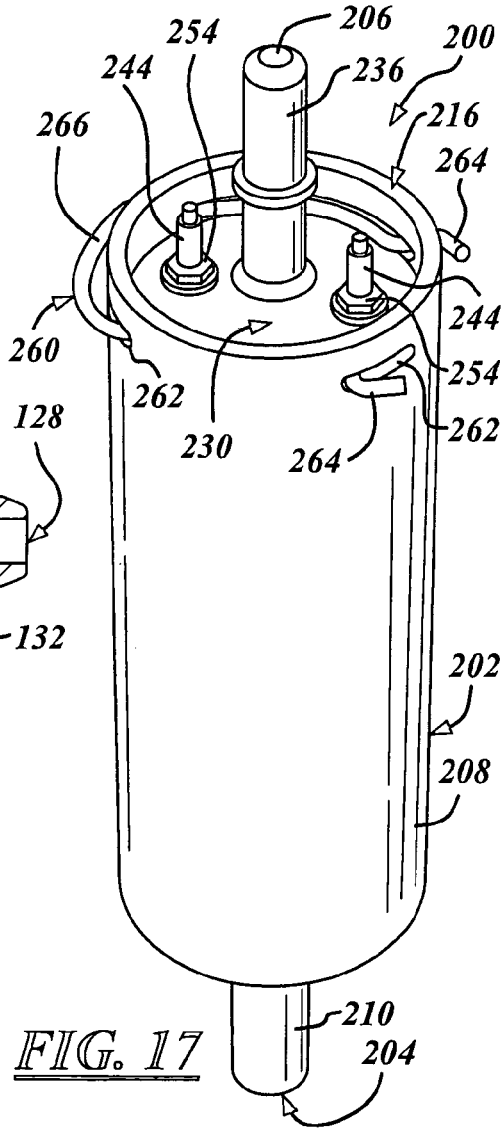
FIG. 17 is a perspective view of another alternate embodiment fluid pump assembly.
Figure 18:
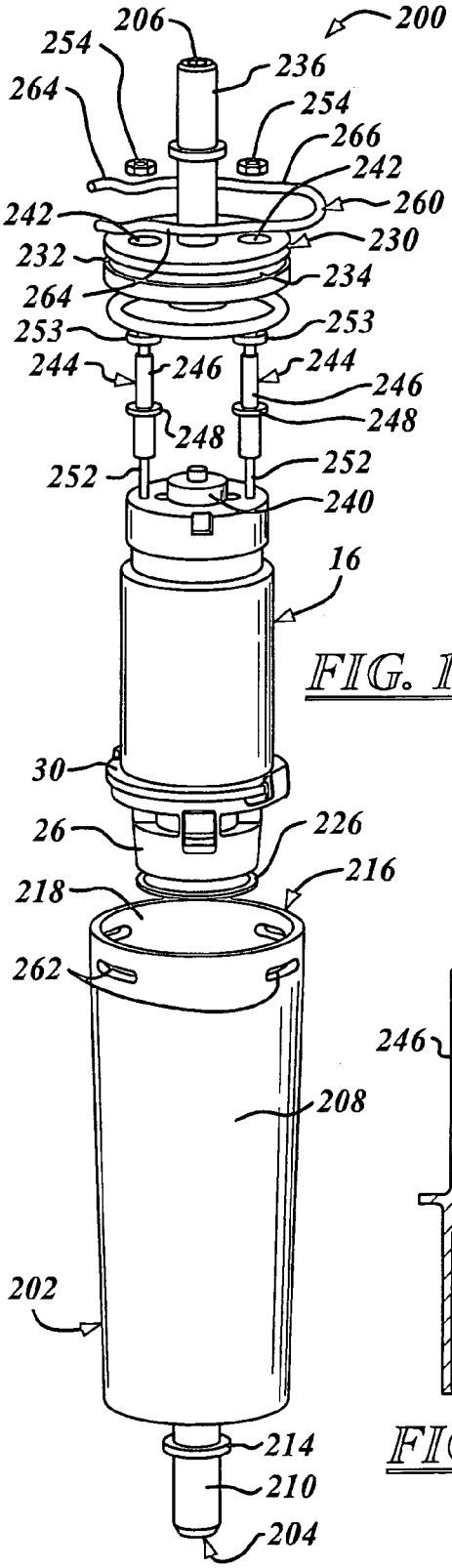
FIG. 18 is an exploded perspective view of the fluid pump assembly of FIG. 17.
Figure 19:
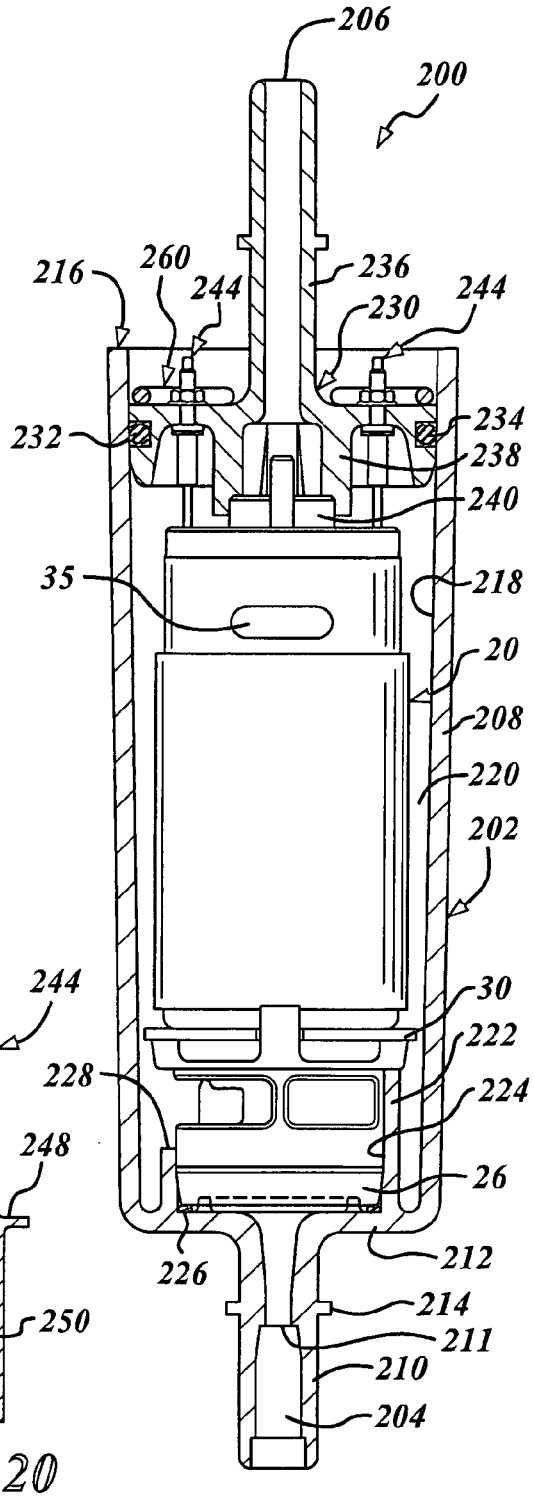
FIG. 19 is a sectional side view of the fluid pump assembly of FIG. 17.

As best shown in FIGS. 17-19, an in-line fuel pump assembly 200 has the pump assembly 10 disposed within an outer generally cylindrical casing 202 having an axially opposed outlet 204 and inlet 206 communicating respectively with the outlet 14 and inlet 12 of the fuel pump assembly 10. Of course, other fuel pump assemblies may be used within the casing 202 with appropriate communication between the inlet and outlet of the fuel pump assembly. The in-line pump assembly may be disposed outside of a fuel tank.

The casing 202 includes a main body having a generally cylindrical sidewall 208 and an outlet passage 204 defined in an outlet fitting 210 depending from and preferably formed in one piece with a lower wall 212 of the main body and preferably having a radially outwardly extending flange 214 facilitating attachment of a fuel line to the outlet fitting 210. The outlet fitting 210 may be adapted for receipt of a check valve (not shown), and may include an annular valve seat 211 in the passage 204. The sidewall 208 preferably is tapered having an increased inner diameter adjacent an open upper end 216 of the main body and a decreasing inner diameter toward the lower wall 212. An inner surface 218 of the side wall 208 preferably is spaced from the fuel pump 10 providing a fuel flow passage 220 between the exterior of the motor module casing 20 and the inner surface 218 of the sidewall 208. The main body preferably also includes an upwardly extending circular inner wall 222 spaced radially inwardly from the sidewall 208 and defining a chamber 224 in which part of the pump body 26 is disposed. The inner wall 222 preferably closes off the outlet 14, and may sealingly engage the rib 139 surrounding the outlet 14. Otherwise, a plug could be disposed in the outlet 14 to close it, if desired. A seal 226 is preferably disposed between a lower edge of the pump body 26 and the lower wall 212 of the casing 202 to prevent fuel leakage between them. The inner wall 222 may provide a stop surface that engages the pump body 26 to support and locate the pump assembly 10 within the casing 202. The inner wall 222 preferably includes an opening 228 in communication with the inlet 206 so that fuel that enters the inlet 206 flows through the flow passage 220 and into the opening 228 whereupon it is routed through the inlet 12 to the gear rotor set 28. Fuel discharged from the gear rotor set 28 flows through the bore 59 in the pump body 26 which is communicated with the outlet passage 204 through which fuel is discharged from the pump assembly 200.

An end cap 230 is disposed in the open upper end 216 of the casing 202 and includes a peripheral groove 232 in which an O-ring or other seal 234 is received to prevent fuel from leaking between the casing 202 and the perimeter of the end cap 230. The end cap 230 has an inlet fitting 236 that defines at least part of the inlet 206 through which fuel enters the casing 202. A central, generally annular depending boss 238 is disposed about a generally cylindrical knob 240 extending from the motor casing 20 and enclosing a bearing for the drive shaft 22, which likewise extends from the motor casing 20 through the knob 240. The end cap 230 further includes a pair of openings 242 (FIG. 18) through which electrical connectors, such as electrically conductive pins 244 extend to permit communication of an electrical source with the fuel pump motor 18. The inlet fitting 236 and outlet fitting 210 may be constructed to receive a quick-connect fluid fitting, such as those commercially available from TI Automotive with regional headquarters in Warren, Mich., USA.

Figure 20:
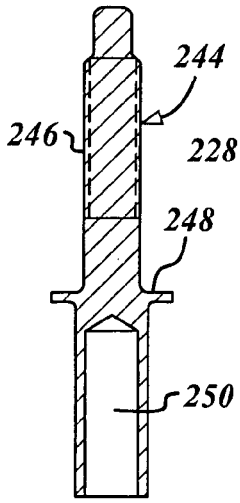
FIG. 20 is a cross-sectional view of an electrical conductor pin which may be used in the fluid pump assembly shown in FIG. 17.

As best shown in FIGS. 18 and 20, the pins 244 preferably include a threaded shank 246, a radially outwardly extending flange 248 and a blind bore 250 (FIG. 20) on the opposite side of the flange 248 from the threaded shank 246. The blind bore 250 receives electrically conductive terminals 252 of the motor 18 that extend from the motor casing 16 and may be permanently connected thereto, such as by solder or other appropriate mechanism. The threaded shank 246 extends through a corresponding opening 242 in the end cap 230 with the flange 248 engaging an inner surface of the end cap 230 (an O-ring seal 253 may be provided between the flange 248 and end cap 230 if desired), and a nut 254 disposed on the threaded shank 246 and bearing on the outer surface of the end cap 230 to interconnect the pins 244 and end cap 230. Of course, other arrangements can be used, for example, the pins 244 could be press-fit into the end cap.

To maintain the position of the end cap 230 relative to the casing 202 and thereby ensure a liquid tight seal between them, a wire retainer 260 is disposed through aligned openings 262 in the casing 202 and overlying the end cap 230 to prevent movement of the end cap 230 toward the open end 216 of the casing 202. The wire retainer 260 is preferably generally U-shaped with a pair of legs 264 and an arcuate bight or central portion 266 with each leg 264 inserted through a corresponding pair of the openings 262 in the casing and with the central portion 266 disposed about the exterior of the sidewall 208. Accordingly, in this embodiment the fuel pump assembly 200 may be connected "in-line" in a fuel system with a fuel line connected to the inlet fitting 236 of the end cap 230, and a separate fuel line connected to the outlet fitting 210 of the casing 202 providing generally axially directed fuel flow into, through and out of the fuel pump assembly 200. The casing 202 and end cap 230 can be formed of any suitable material and may be electrically conductive, if desired, for static electric charge dissipation or other reasons.

Figure 21:
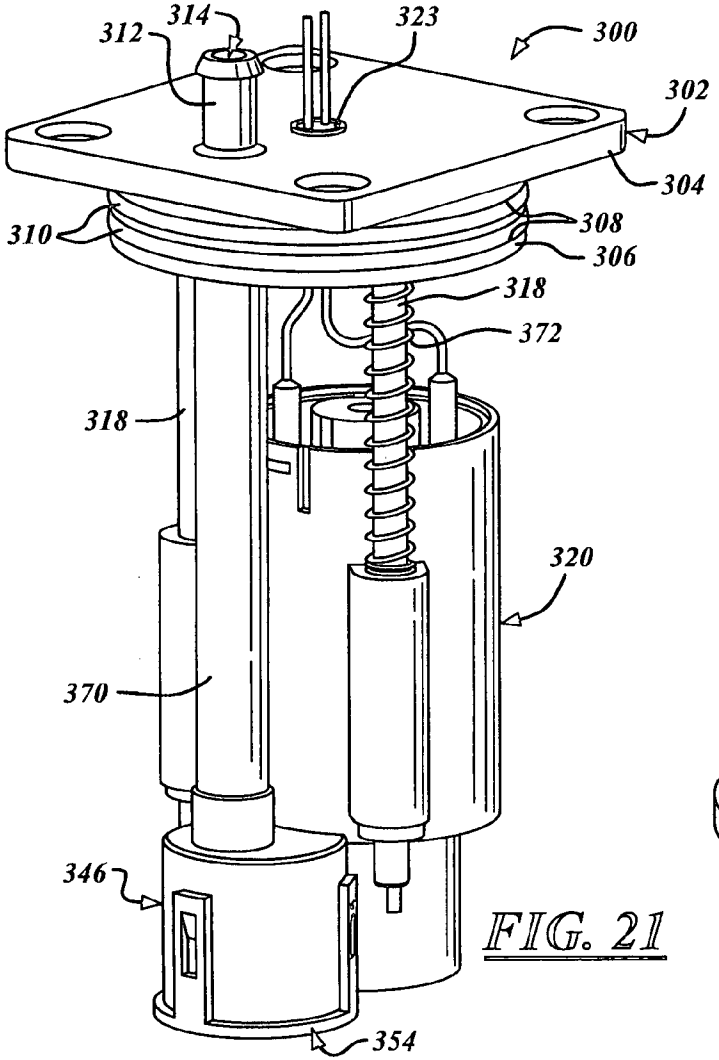
FIG. 21 is a perspective view of a fluid pump module including one embodiment of a fluid pump assembly.
Figure 22:
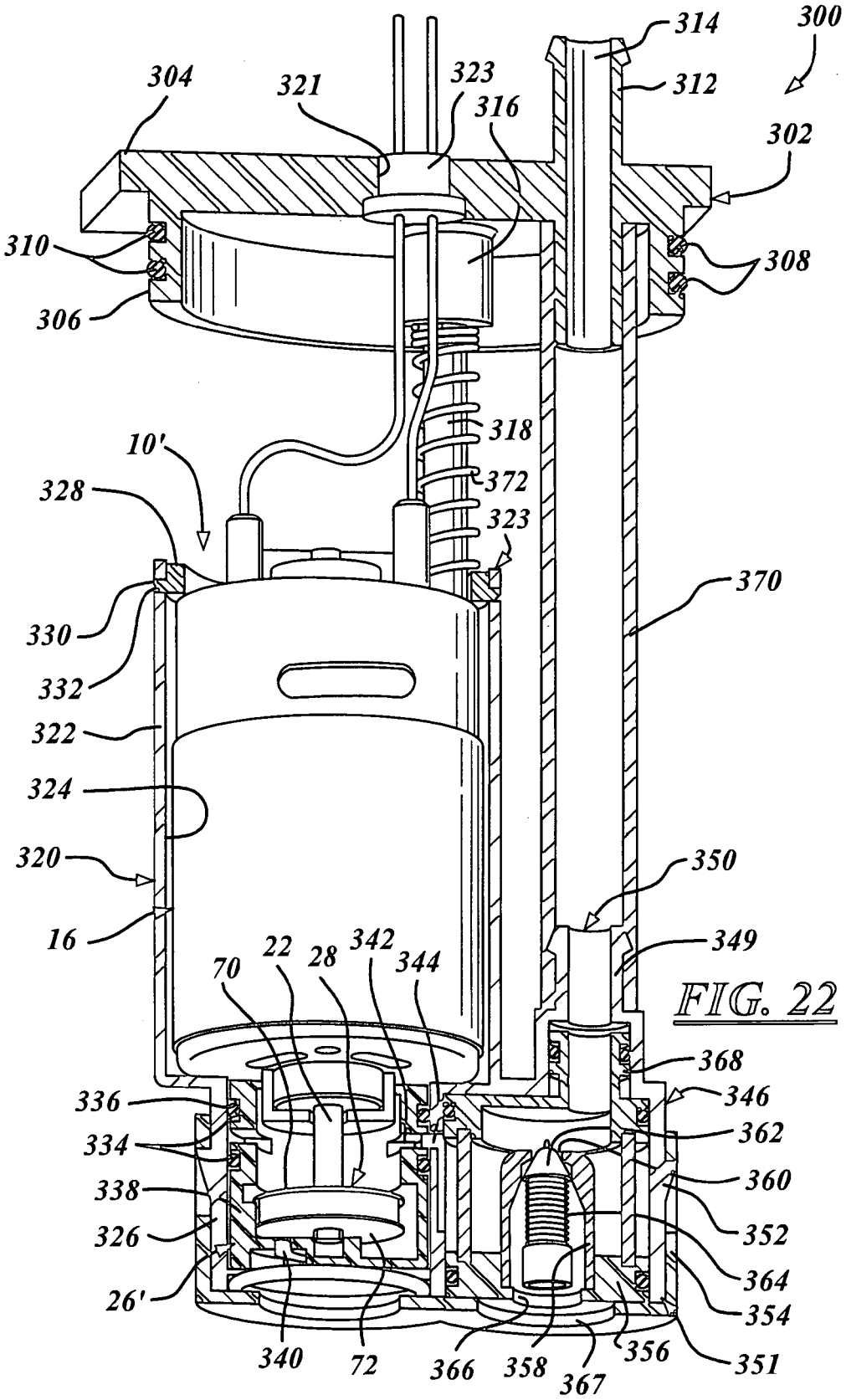
FIG. 22 is a perspective sectional view of the module of FIG. 21.

As shown in FIGS. 21 and 22, a fuel pump assembly 10' can be used within a fuel supply module 300 adapted to be mounted on and extend into the interior of a vehicle fuel tank (not shown). The module 300 includes a mounting flange 302 including an upper portion 304 adapted to overly an opening in a fuel tank, and a cylindrical depending skirt 306 having one or more circumferentially continuous grooves 308 each of which receives a seal 310 to provide a seal between the mounting flange 302 and a wall or other surface of the fuel tank. The mounting flange 302 may be connected to the tank by a suitable adhesive, may be threaded and engaged with the tank, may be coupled to the tank by one or more connectors such as bolts or screws, or may be bonded to the tank such as by various forms of welding or heat treatment, by way of examples without limitation. The flange 302 preferably includes an integrally molded outlet fuel fitting 312 providing an outlet passage 314 through which fuel may pass through the flange 302. The flange 302 preferably also includes one or more depending bosses 316 which each receive a portion of a corresponding rod 318 used to support a fuel pump holder 320 of the module 300 relative to the flange 302. The flange 302 preferably also includes an opening 321 for a pass-through electrical connector 323 through which electrical power is provided to the fuel pump motor.

The fuel pump holder 320 preferably includes a generally cylindrical wall portion 322 open at one end 323 facing the flange 302 and defining a chamber 324 in which the fuel pump motor module 16 is received, and a smaller diameter cylindrical wall portion 326 extending therefrom and in which a pump body 26' is received. Preferably, a snap-ring retainer 328 with outwardly extending tabs 330 is disposed in the cylindrical wall 322 with the tabs 330 extending into openings or slots 332 formed in the wall 322 to retain the fuel pump in the chamber 324. Also preferably, one or more seals 334, such as O-rings are disposed between the pump body 26' and the lower wall portion 326. To receive the seals 334, the pump body 26' preferably has one or more circumferentially continuous grooves 336 in which the seals are received, and may have a generally straight cylindrical sidewall 338 received adjacent to an inner surface of the lower wall portion 326. The pump body 26' has an inlet 340 through which fuel is received from the fuel tank, and an outlet 342 through which fuel is discharged under pressure.

The outlet 342 of the pump body 26' communicates with an inlet 344 of a fuel pressure regulator assembly 348. The regulator assembly 348 preferably includes a regulator holder 346 that is open at one end 351 generally facing away from the flange 302, is preferably integrally formed in one piece with the pump holder 320 and includes a fuel line fitting 349 defining an outlet 350 in communication with the inlet 344, and one or more radially outwardly extending barbs 352 for snap-fit receipt of a cover 354. An inner regulator housing 356 is disposed within the regulator holder 346 and includes an insert 358 defining a valve seat 360 against which a valve head 362 is yieldably biased by a spring 364 to prevent fuel flow through the valve seat 360 until a pressure of fuel acting on the valve head 362 is sufficient to displace it from the valve seat 360. When the valve head 362 is displaced from the valve seat 360, fuel flows through the valve seat 360 and out of a bypass outlet 366 of the fuel pressure regulator 348, which leads to an opening 367 in the cover 354. The inner housing 356 includes an outlet passage portion 368 which preferably extends at least partially into the fuel line fitting 349 so that fuel discharged from the body 26' flows through the inlet 344 of the fuel pressure regulator holder 346, is communicated with the valve head 362, and flows out of the outlet passage 350 and fitting 349, and through a fuel line 370 interconnecting the fuel fitting 349 and the outlet passage 314 of the flange 302. Accordingly, through the fuel flow path just described fuel is discharged from the fuel pump and out of the fuel tank.

Desirably, the fuel supply module 300 can readily be assembled of several modular components each of which may be used in other assemblies or fuel pump modules as desired. For example, the motor module 16 and pump body 26 may be as disclosed as in the prior embodiments in which case the interior features of the pump holder 320 may be the same as or similar to the interior of the casing 202, or may have the particular pump body 26' as shown in FIG. 22. Likewise, any suitable fuel pressure regulator, including diaphragm based pressure regulators, can be carried by the pump holder 320 to regulate the outlet pressure of fuel discharged from the module 300 if in-tank fuel pressure regulation is desired. Desirably, the fuel pump assembly 10' is retained by the snap-fit retainer 328, and the pressure regulator 348 is retained on the pump holder 320 by the cover 354 which snap-fits to the regulator holder 346. Further, the fuel line 370 can be flexible permitting adjustment of the distance between the pump holder 320 and the flange 302, and a spring 372 disposed around each rod 318, preferably yieldably biases the lower end of the module 300 away from the flange 302 and against a bottom wall of the fuel tank to ensure that inlet of the fuel pump assembly is closely adjacent to the bottom wall of the tank.

Figure 23:
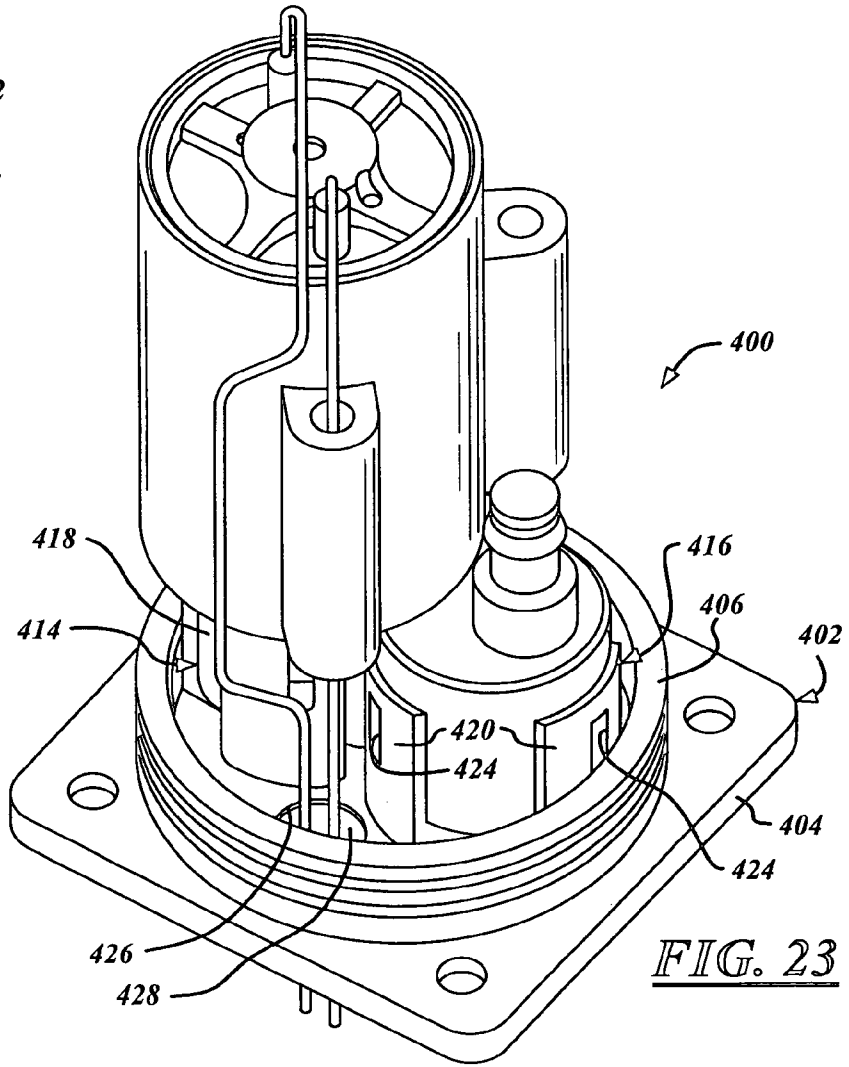
FIG. 23 is a perspective view of another embodiment fluid pump module including one implementation of a fluid pump assembly.
Figure 24:
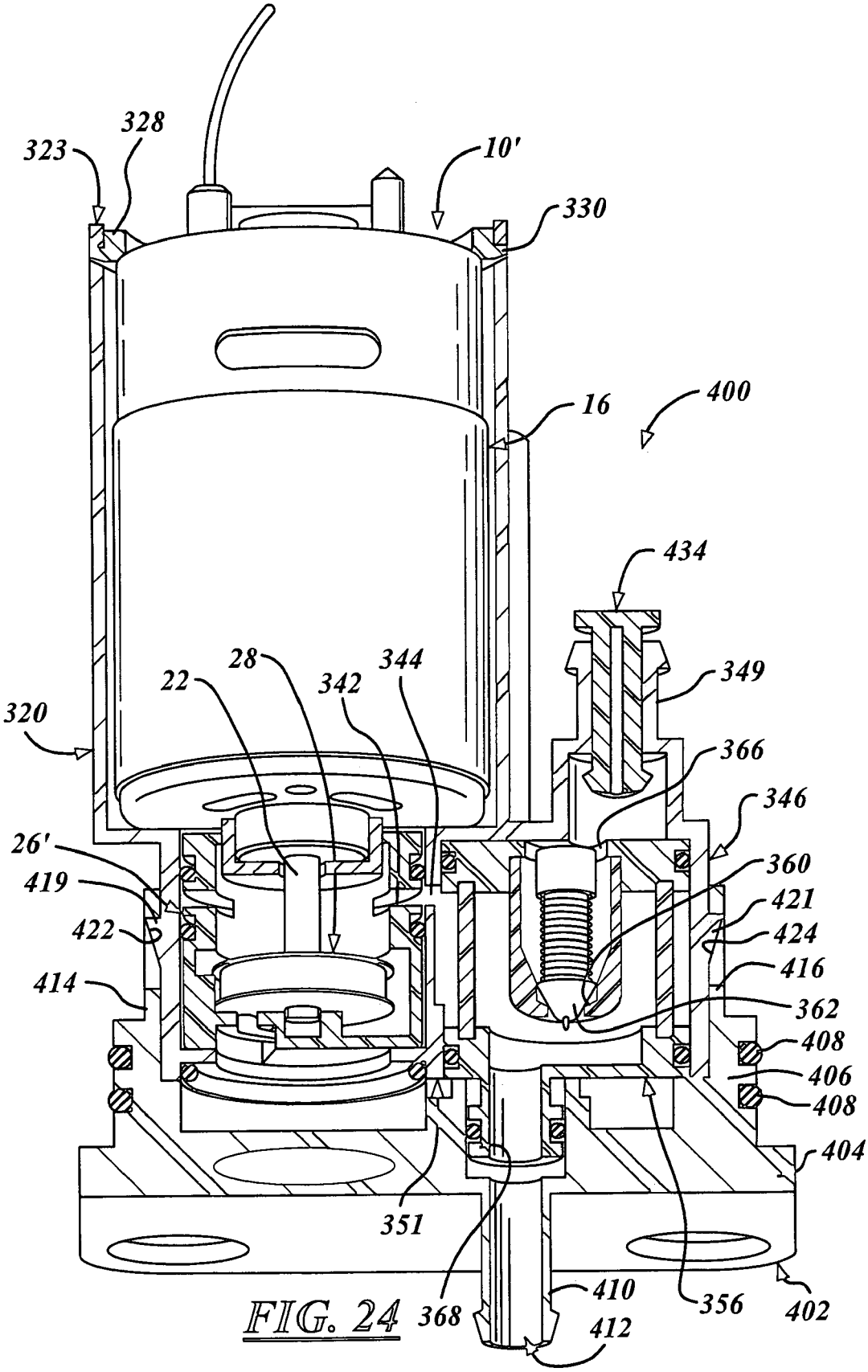
FIG. 24 is a perspective sectional view of the fluid pump module of FIG. 23.

FIGS. 23 and 24 show a fuel supply module 400 that includes many components in common with the previously discussed fuel supply module 300 and the same reference numbers are used to denote similar components. In this fuel supply module 400, the flange 402 is adapted to be received in an opening formed in a lower wall of a fuel tank. The flange 402 has an outwardly extending rim 404 adapted to overly a portion of the fuel tank, and a first cylindrical portion 406 extending from the rim and carrying at least one circumferentially continuous seal 408 so that in assembly a fluid tight seal is provided between the mounting flange 402 and the fuel tank. The flange 402 also includes an outlet fuel fitting 410 defining part of a passage 412 through the flange 402, a generally cylindrical pump body retainer 414 and a generally cylindrical fuel pressure regulator retainer 416 that preferably are formed in one piece with the mounting flange 402. Both the pump body retainer 414 and pressure regulator retainer 416 may include a plurality of upstanding fingers 418, 420, respectively, generally circumferentially spaced apart and including openings 422, 424, respectively, or slots through which associated barbs 419, 421 of the pump holder 320 and regulator holder 346 may extending for snap-fit receipt of these components. The flange 402 preferably also includes an opening 426 for a pass through electrical connector 428, as previously described.

The pump holder 320 may be constructed substantially identical to the pump holder 320 previously disclosed. The pump holder 320 preferably includes a plurality of outwardly extending barbs 419, 421 that are disposed within the openings 422 in the pump body retainer 414 and pressure regulator retainer 416 so that the pump holder 320 is snap-fit to the mounting flange 402 with the pump body 26' adjacent to the mounting flange 402 and the motor module 16 extending away from the mounting flange 402. The open end 323 of the pump holder 320 is facing away from the flange 402.

The fuel pressure regulator inner housing 356 is received within the regulator holder 346 so that its fuel outlet passage 368 extends into the passage 412 in the flange 402 leading to the fuel outlet fitting 410. The bypass outlet 366 of the regulator leads to the fuel line fitting 349 of the pump body 320 which, in this arrangement, is utilized to route bypass fuel from the regulator rather than the outlet fuel discharged from the fuel pump as in the module 300. To reduce fuel spray within the fuel tank, a diffuser or fuel control body 434 is disposed within the fuel line fitting 349 and preferably modifies the path taken by any fuel discharged from the bypass outlet of the fuel pressure regulator. The operation of the fuel pump assembly in this module 400 is substantially similar to that of the prior module 300. Fuel is taken into the fuel pump through the inlet 340 and is discharged under pressure through the outlet 342 of the pump body 26'. From there, the fuel flows through the inlet 344 of the fuel pressure regulator housing 356, is communicated with the valve 362, and at least some fuel exits the outlet 368 of the regulator and flows through the outlet passage 412 of the flange 402. If the fuel pressure at the valve 362 is greater than a threshold pressure, some fuel will be discharged from the bypass outlet 366 of the regulator housing 356.

Accordingly, the mounting flange 402 may be generally the same as disclosed in the embodiment of FIGS. 21 and 22, or may be modified as shown herein. The pump holder 320, fuel pressure regulator 348 and fuel pump assembly 10' may be substantially identical to that shown in FIGS. 21 and 22. The pump body 26 or 26' can be used, or another suitable design for use with the fuel pump. A plurality of common components can be used in various configurations of fuel pump assemblies and fuel pump modules as in the representative examples shown and described herein.

Figures 25, 26, 28:
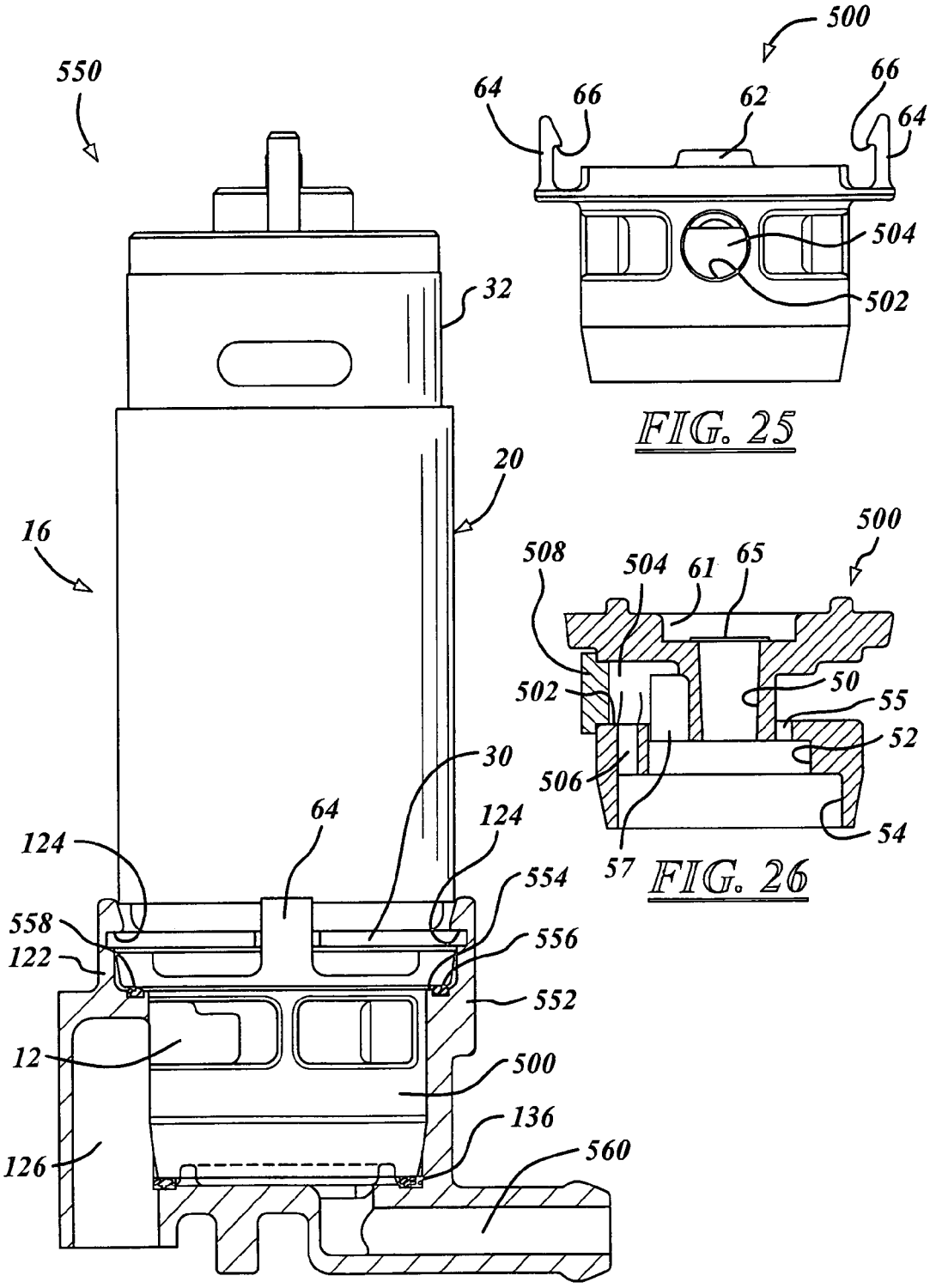
FIG. 25 is a side view of a modified housing of a fluid pump assembly.
FIG. 26 is a sectional view of the housing of FIG. 25.
FIG. 28 is a fragmentary side view of the fluid pump assembly showing a second housing in section.

FIGS. 25 and 26 show a modified pump body 500 that may be used in place of the pump body 26, 26' on a fuel pump assembly 10, 10' in the same manner as previously described. The pump body 500 may be substantially identical to the prior pump bodies 26, 26', with exceptions as noted herein. Similar parts, portions or components have been given the same reference numbers as in the previous embodiments 26, 26' where practical to facilitate description of the pump body 500.

Instead of the rounded rectangular outlet opening 14 and fuel passage 58 (see e.g. FIG. 6) as in the pump bodies 26, 26', the pump body 500 preferably has a round hole 502, a passage 504 extending from the hole 502 to the outlet slot 57, and an outlet passage 506 communicating the passage 504 with the second counterbore 54. As shown in FIG. 26, a plug 508 is preferably sealed in the hole 502 to prevent fluid flow therethrough. So fluid discharged from the gear rotors 28 (or other pumping element used in the pump assembly) flows through the wear plate 70, the outlet slot 57 in the pump body 500, the passage 504, and the outlet passage 506 where fuel is discharged from the pump body 500. Otherwise, the pump body 500 may be constructed and arranged as set forth with respect to the previously described pump bodies 26, 26' so the pump body 500 will not be further described.

Figure 27:
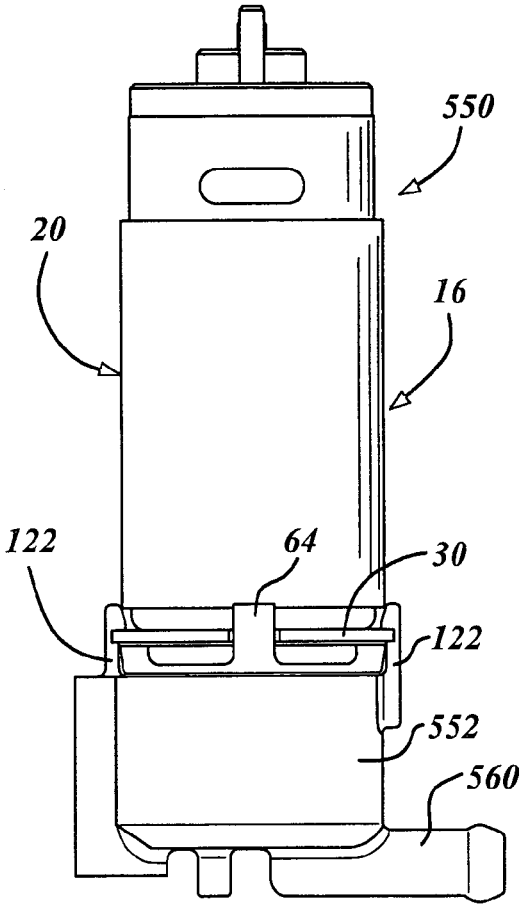
FIG. 27 is side view of a modified fluid pump assembly.

FIGS. 27 and 28 illustrate a fluid pump assembly 550 that includes a fuel pump assembly 10, the pump body 500 and a second housing 552 disposed at least partially over or surrounding the pump body 500. In this regard, the fluid pump assembly 550 is similar to the fuel pump assembly 118 shown in FIGS. 14-16, and the second housing 552 is similar to the second housing 120 previously described herein. Accordingly, where practical to facilitate description of the pump assembly 550 and second housing 552, where they have the same or similar parts, portions or components as the assembly 118 and second housing 120, the same reference numerals will be used.

Figure 3:
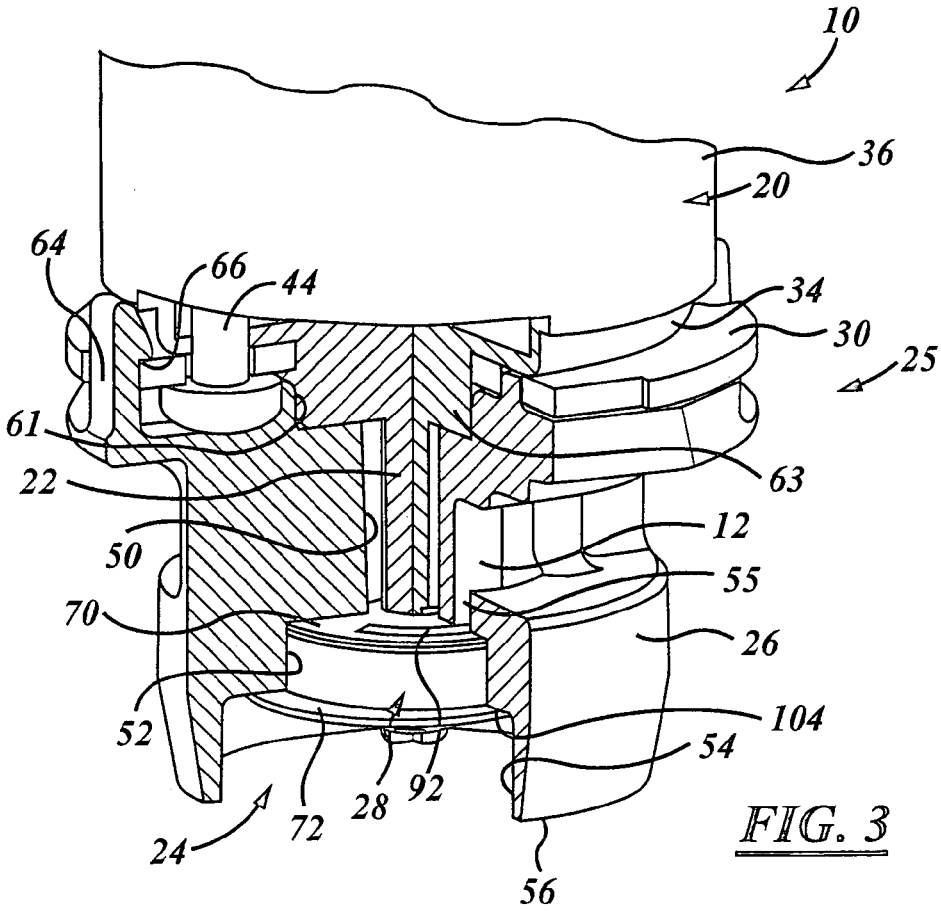
FIG. 3 is a fragmentary sectional view of the fluid pump assembly.
Figure 4:
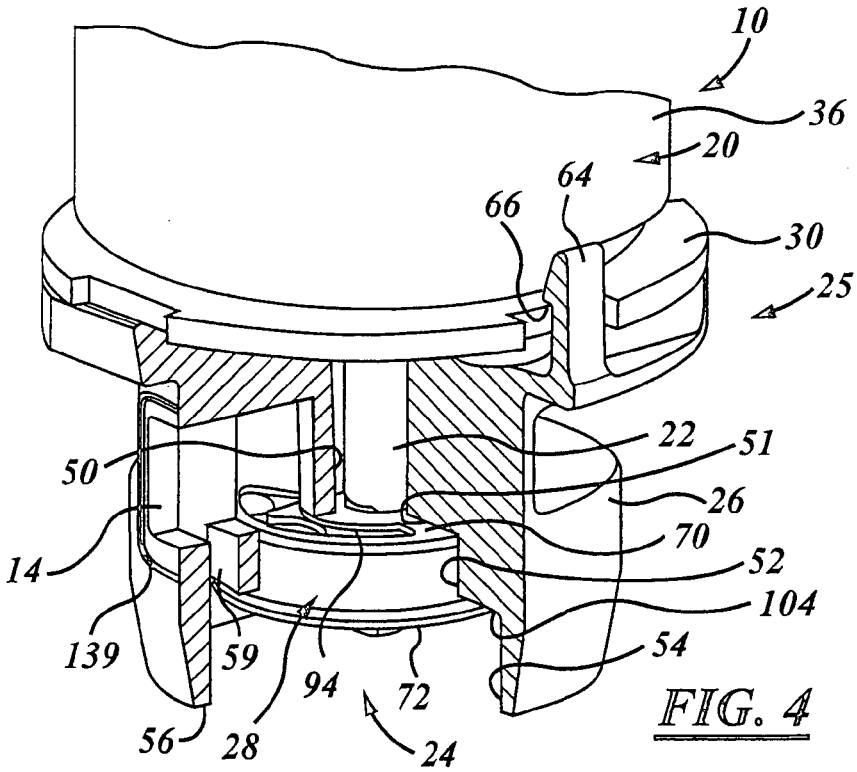
FIG. 4 is another fragmentary sectional view of the fluid pump assembly illustrating an outlet port and fluid flow path.
Figure 5:
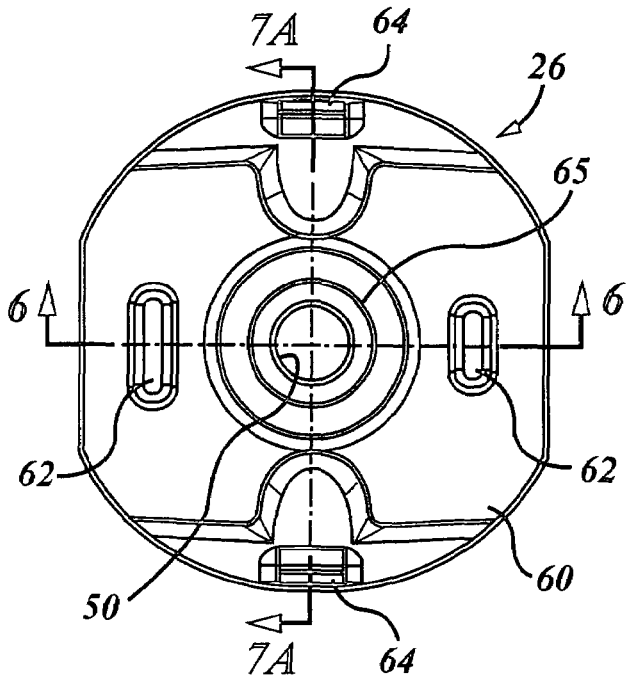
FIG. 5 is a plan view of a housing of the fluid pump assembly.
Figure 7A:
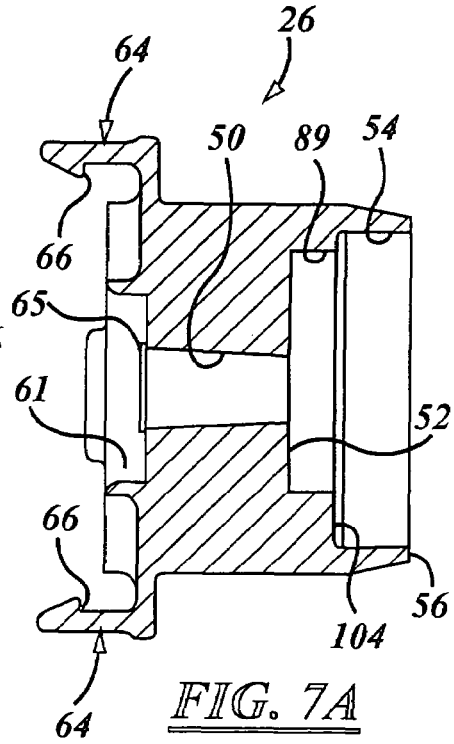
FIG. 7A is a cross-sectional view of the housing taken generally along line 7A-7A in FIG. 5.
Figure 6:
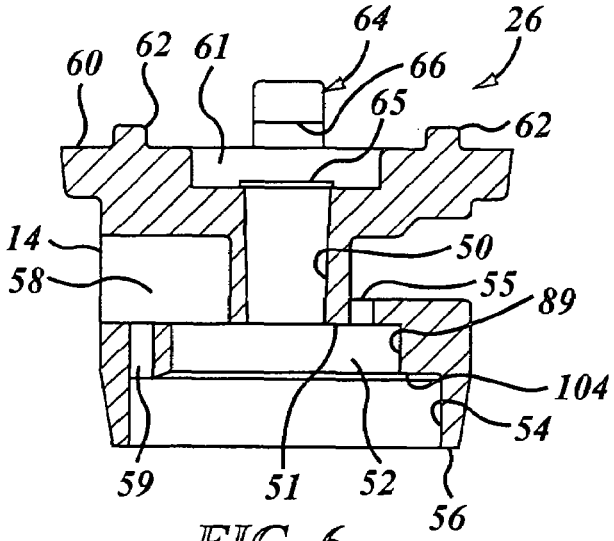
FIG. 6 is a cross-sectional view of the housing taken generally along line 6-6 in FIG. 5.

The second housing 552 preferably includes a radially inwardly extending annular ledge or rim 554 in which a groove 556 is formed. An O-ring 558 is disposed in the groove 556 and in assembly, the O-ring 558 is disposed between the pump body 500 and the second housing 552 to provide a fluid tight seal between them. The second housing 552 preferably includes the inlet passage 126, and an outlet passage 560 which is open to the open lower end of the pump body 500 and in communication with the outlet passage 506 (as shown in FIG. 26). Preferably, the outlet passage 506 is spaced from the seal 72 and backing plate 74 and opens to the second counterbore 54 on the opposite side of the seal 72 and backing plate 74 as the gear rotor set 28 (the gear rotor set 28, backing plate 74, seal 72 and related components are not shown in FIG. 27 or 28, but may be constructed and arranged as shown in FIGS. 3 and 4). Accordingly, outlet fluid pressure tends to act on the backing plate 74 and seal 72 in a direction tending to move them toward the gear rotor set 28 and this helps reduce or prevent leakage from the gear rotor set 28 and improves the efficiency of the fluid pump assembly 550. Additionally, the pressurized fuel outlet 560 is farther away from the seal 558 than was the outlet 128 in the prior assembly 118 with regard to the seal 134 to further reduce or prevent leakage between the pump body 500 and the second housing 552.

Figure 29:
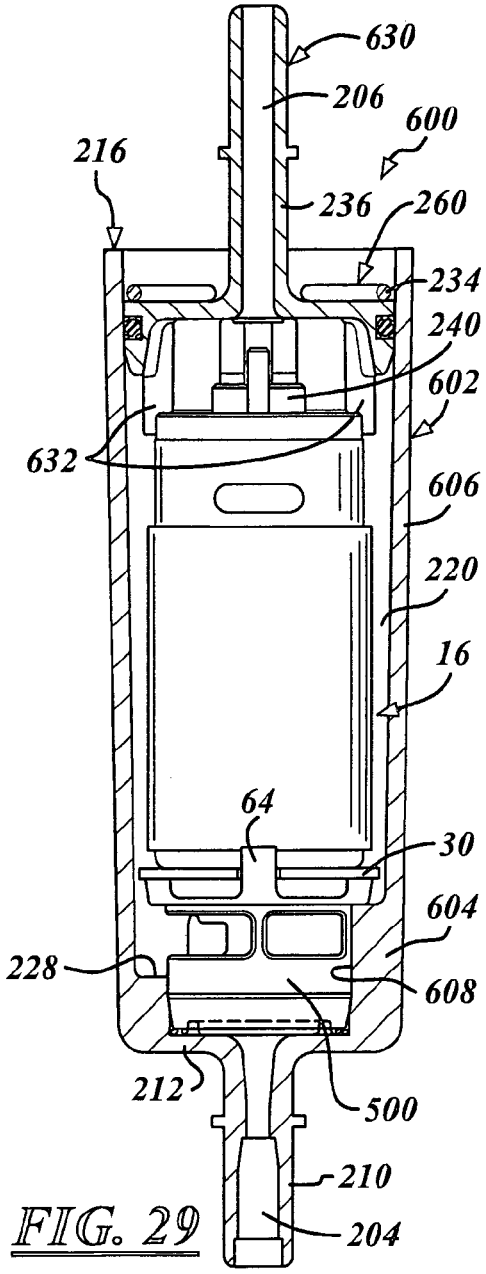
FIG. 29 is a side view of another alternate embodiment fluid pump assembly with a casing and end cap in section to facilitate illustration of other components.
Figure 30:
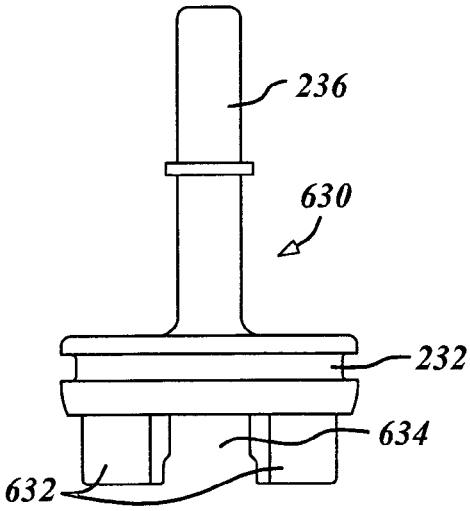
FIG. 30 is a side view of the end cap of the fluid pump assembly of FIG. 29.
Figure 31:
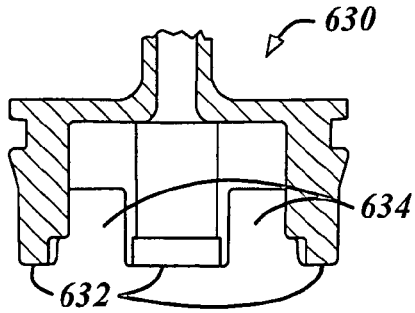
FIG. 31 is a fragmentary sectional view of the end cap of FIG. 30.

Another pump assembly 600 shown in FIG. 29 is similar to the fuel pump assembly 200 shown in FIGS. 17-19. Where practical to facilitate description of the pump assembly 600, where it has the same or similar parts, portions or components as the assembly 200, the same reference numerals will be used.

The pump assembly 600 includes an outer casing 602 that is similar to the casing 202 of the pump assembly 200, but may have a thicker lower portion 604 of its sidewall 606 defining a cavity 608 in which the pump body 500 is received. Because the hole 502 in the pump body 500 is closed by the plug 508 (neither the hole 502 nor plug 508 are shown in FIG. 29, but may be arranged as shown in FIG. 26), no seal is needed between the pump body 500 and the casing 602 in the area of the hole 502. The thicker wall portion 604 essentially includes or incorporates the inner wall 222 of the pump assembly 200 into the sidewall 606 of the casing 602.

The pump assembly 600 also includes an end cap 630 which is similar to the end cap 230 of the pump assembly 200 except that the end cap 630 does not include the depending boss 238 to engage the knob 240 of the motor module. Instead, the end cap 630 includes a support surface 632 or multiple support surfaces 632 adapted to engage the upper end cap 32 of the motor module 16, preferably about some portion of the periphery of the motor module 16. One or more slots 634 are preferably formed in the end cap 630 to provide a gap or gaps between the upper end cap 32 and the end cap 630 through which fuel may flow from the inlet passage 206 to the flow passage 220 in the casing 602. Accordingly, the end cap 630 does not engage the motor module 16 in the area of the knob 240 and the drive shaft bearing in the knob 240, to reduce or prevent any detrimental affect on the rotation of the drive shaft 22. The end cap 630 may otherwise be the same as the end cap 230 and hence, it will not be further described.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit and scope of the invention as defined by the following claims. For example, while several of the presently preferred implementations discuss pumping fuel, fuel pumps and fuel pump assemblies incorporating the inventions discussed herein can be readily applied to other applications to pump other fluids. One such example is to pump liquids used to cool computer components, although many other examples and uses are possible.

The invention claimed is:

1. A fuel pump, comprising:

an electric motor including a casing enclosing at least a portion of the motor and a drive shaft extending from the casing and driven for rotation about an axis by the motor;

a separate housing releasably coupled to the casing, enclosing at least part of the drive shaft and having an inlet through which fuel enters the housing and an outlet through which fuel exits the housing;

an inner gear rotor in the housing and coaxially aligned with and coupled to the drive shaft for rotation with the drive shaft about an axis;

an outer gear rotor in the housing, encircling the inner gear rotor and driven for rotation by the inner gear rotor about an axis offset from the axis of rotation of the inner gear rotor providing a plurality of pumping chambers between the inner gear rotor and outer gear rotor; and a wear plate in the housing and disposed between the motor and the inner and outer gear rotors, and having an inlet port in communication with the inlet and through which fuel enters the pumping chambers, and an outlet port in communication with the outlet and through which fuel is discharged from the pumping chambers.

2. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers; and the drive shaft is noncircular in cross-section providing at least one driving surface that engages the inner gear rotor.

3. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers;

a seal disposed adjacent the opposite side of the inner and outer gear rotors from the wear plate; and the housing is coupled to the casing at one end and is generally open at its other end permitting access to the drive shaft, and the seal at least substantially prevents fuel from entering or exiting the pumping chambers through said opposite side of the inner and outer gear rotors.

4. The fuel pump of claim 3 wherein at least one driving surface of the drive shaft engages the seal to rotate the seal with the drive shaft.

5. The fuel pump of claim 2 wherein the housing includes a pocket that locates the outer gear rotor relative to the drive shaft.

6. The fuel pump of claim 2 wherein the inner gear rotor includes an opening in which the drive shaft is received that is complementary in shape to the drive shaft.

7. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers; and the housing includes a mounting plate attached to the casing and a pump body coupled to the mounting plate with the inner and outer gear rotors disposed on the opposite side of the mounting plate as the motor.

8. The fuel pump of claim 3 which also comprises a biasing member that yieldably biases the seal toward the inner and outer gear rotors.

9. The fuel pump of claim 8 wherein the biasing member is coupled to the drive shaft for rotation with the drive shaft.

10. The fuel pump of claim 2 which also comprises a clip secured to the drive shaft to retain the inner and outer gear rotors on the drive shaft.

11. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers; and a second housing disposed adjacent to the housing and including an outlet passage in communication with the housing outlet so that fuel discharged from the pumping chambers flows through the housing outlet and the outlet passage of the second housing.

12. The fuel pump of claim 11 wherein the second housing surrounds at least a portion of the housing.

13. The fuel pump of claim 11 wherein the housing includes a mounting plate attached to the casing and a pump body coupled to the mounting plate with the inner and outer gear rotors disposed on the opposite side of the mounting plate as the motor, and wherein the second housing is coupled to the mounting plate.

14. The fuel pump of claim 13 wherein the second housing includes at least one latch including a catch adapted to engage the mounting plate to retain the second housing.

15. The fuel pump of claim 11 wherein the housing includes an open end spaced from the mounting plate and wherein the second housing closes the open end.

16. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers; and an outer casing enclosing the casing and the housing, and having an inlet through which fuel enters the outer casing prior to entering the pumping chambers, and an outlet through which pressurized fuel is discharged from the outer casing.

17. The fuel pump of claim 16 wherein the outer casing includes a sidewall surrounding the casing and housing and one of the inlet of the outer casing and the outlet of the outer casing is formed in one-piece with the sidewall.

18. The fuel pump of claim 17 wherein one of the inlet of the outer casing and the outlet of the outer casing is formed in a separate body coupled to the sidewall.

19. The fuel pump of claim 16 wherein the inlet of the outer casing and the outlet of the outer casing are communicated together by a fuel flow path that is defined at least in part between the casing and the sidewall.

20. A fuel pump, comprising:

an electric motor including a casing enclosing at least a portion of the motor and a drive shaft extending from the casing and driven for rotation about an axis by the motor;

a housing coupled to the casing, enclosing at least part of the drive shaft and having an inlet through which fuel enters the housing and an outlet through which fuel exits the housing;

an inner gear rotor coaxially aligned with and coupled to the drive shaft for rotation with the drive shaft about an axis;

an outer gear rotor driven for rotation by the inner gear rotor about an axis offset from the axis of rotation of the inner gear rotor providing a plurality of pumping chambers between the inner gear rotor and outer gear rotor;

a wear plate disposed between the motor and the inner and outer gear rotors, and having an inlet port in communication with the inlet and through which fuel enters the pumping chambers, and an outlet port in communication with the outlet and through which fuel is discharged from the pumping chambers;

a mounting flange adapted to be sealed to a fuel tank and having an outlet through which fuel is discharged from the fuel tank; and a pump holder carried by the mounting flange and having a cavity in which the motor and housing are received, an inlet through which fuel enters the pump holder and an outlet communicated with the outlet of the mounting flange.

21. The fuel pump of claim 20 which also includes a fuel pressure regulator having an inlet in communication with the pump holder outlet, a valve responsive to the pressure of fuel at the inlet and an outlet downstream of the valve through which fuel is discharged from the fuel pressure regulator, whereby the valve is displaced by fuel at a pressure above a threshold pressure to permit fuel flow out of the fuel pressure regulator to limit the maximum pressure of fuel discharged from the mounting flange outlet.

22. The fuel pump of claim 21 wherein the fuel pressure regulator is carried by the pump holder.

23. The fuel pump of claim 20 which also includes a rod carried at one end by the mounting flange and coupled to the pump holder to interconnect the mounting flange and pump holder.

24. The fuel pump of claim 20 which also includes a fuel line communicating the pump holder outlet with the mounting flange outlet.

25. The fuel pump of claim 20 wherein the pump holder is directly connected to the mounting flange.

26. The fuel pump of claim 25 wherein the mounting flange includes a pump body retainer adapted to extend into a fuel tank and the pump holder is connected to the pump body retainer.

27. The fuel pump of claim 18 wherein the separate body includes at least one opening therethrough and at least one electrical connector that extends through the opening to permit electrical connection to the motor.

28. The fuel pump of claim 27 wherein the motor includes a terminal and said at least one electrical connector is mated with the terminal at one end and extends through the opening for communication with an electrical source disposed outside of the outer casing.

29. The fuel pump of claim 28 wherein the electrical connector includes a bore in which the terminal is disposed, and a shank disposed outboard of the opening and having a threaded section on which a nut is received to retain the position of the separate body relative to the outer casing.

30. The fuel pump of claim 18 which also includes a retainer carried by the outer casing and overlying a portion of the separate body to retain the position of the separate body relative to the outer casing.

31. The fuel pump of claim 20 which also comprises:

a fuel pressure regulator disposed downstream from the fuel pump and having a regulator housing with an inlet in communication with the outlet of the fuel pump, an outlet in communication with the outlet passage and a bypass outlet from which fuel is discharged from the regulator housing; and a regulator holder that is carried by the mounting flange, receives at least a portion of the regulator housing, is formed in one-piece with the pump holder and has an inlet in communication with the pump holder outlet, an outlet in communication with both the fuel pressure regulator outlet and with the outlet of the mounting flange and a bypass outlet from which fuel is returned to the fuel tank.

32. The fuel pump of claim 31 wherein the pump holder is connected to the mounting flange.

33. The fuel pump of claim 31 wherein the pump holder is snap-fit to the mounting flange.

34. The fuel pump of claim 31 which also includes a rod carried at one end by the mounting flange and associated with the pump holder to couple the pump holder to the mounting flange.

35. The fuel pump of claim 34 which also comprises a biasing member acting on the pump holder to yieldably bias the pump holder away from the mounting flange.

36. The fuel pump of claim 31 which also includes a cover, wherein the regulator holder is open at one end to permit insertion of the regulator therein and the cover is carried by the regulator holder to retain the regulator in the regulator holder and the cover has an opening that defines the bypass outlet of the regulator holder.

37. The fuel pump of claim 31 wherein the pump holder includes an open end through which the fuel pump is received into the pump holder and the regulator holder includes an open end through which the regulator is received into the regulator holder and the direction that the open end of the fuel pump holder faces is opposite to the direction that the open end of the regulator holder faces.

38. The fuel pump of claim 7 wherein the outer casing has a sidewall, an end wall at one end of the sidewall and an end cap spaced from the end wall to define a chamber in the outer casing, and an inlet in which fuel is received into the chamber and an outlet through which fuel is discharged from the chamber, and wherein the end cap is removably secured to the sidewall and defines one of the inlet or outlet of the outer casing and otherwise closes an end of the sidewall opposite the end wall.

39. The fuel pump of claim 38 which also includes a retainer releasably coupled to the sidewall and engaging the end cap to retain the position of the end cap relative to sidewall.

40. The fuel pump of claim 38 wherein the end cap includes at least one opening through which an electrical connector extends to communicate a source of electricity with the electric motor.

41. The fuel pump of claim 40 wherein the fuel pump includes at least one terminal and the electrical connector includes a pin that is electrically connected to the terminal at one end and includes a flange that engages an inner surface of the end cap that defines part of the chamber and a threaded shank that extends through the opening and on which a nut is received against an outer surface of the end cap.

42. The fuel pump of claim 38 wherein the other of the inlet and outlet that is not defined by the end cap is formed in one piece with the end wall.

43. The fuel pump of claim 42 wherein the inlet and outlet are parallel.

44. The fuel pump of claim 38 which also includes a casing surrounding at least a portion of the motor and wherein fuel discharged from the pumping element flows between the outer casing and said casing surrounding at least a portion of the motor.

45. The fuel pump of claim 44 wherein said casing surrounding at least a portion of the motor is sealed against fuel intrusion.

46. The fuel pump of claim 45 which also includes a housing disposed within the outer casing and having an outlet in communication with the chamber and the exterior of said casing surrounding at least a portion of the motor, and wherein the motor includes a drive shaft extending from said casing surrounding at least a portion of the motor, and said at least one pumping element is received in the housing and is driven for rotation by the drive shaft.

47. A fuel pump, including:

a motor in a sealed casing and having a drive shaft extending from the casing and rotated by the motor about an axis;

a housing carried by the casing at one end and having an open opposite end providing access to the drive shaft, an inlet and an outlet;

a wear plate having a portion engaged with the housing to hold the wear plate against rotation relative to the housing, an opening coaxially aligned with and through which the drive shaft is received, an inlet port in communication with the inlet and an outlet port in communication with the outlet;

a gear rotor set including an inner gear rotor with an opening coaxially aligned with and through which the drive shaft is received so that the inner gear rotor rotates with the drive shaft and an outer gear rotor surrounding the inner gear rotor and driven for rotation by the inner gear rotor with pumping chambers defined between the gear rotors that enlarge in the area of the inlet and become smaller in the area of the outlet, the gear rotor set being disposed on the opposite side of the wear plate as the motor;

a seal having an opening coaxially aligned with and through which the drive shaft is received so that the seal rotates with the drive shaft and being disposed on the opposite side of the gear rotors as the wear plate to sealingly engage said opposite side of the gear rotors and inhibit fuel flow into the pumping chambers through said opposite side; and a retainer carried by the drive shaft to retain the seal, gear rotor set and wear plate on the drive shaft.

48. The fuel pump of claim 47 wherein the drive shaft has a non-circular shape and the openings of the inner gear rotor and seal are complementarily shaped to the drive shaft for driving engagement of the drive shaft with the inner gear rotor and seal.

* * * * *